US008827730B2

(12) United States Patent
Ihara

(10) Patent No.: US 8,827,730 B2
(45) Date of Patent: Sep. 9, 2014

(54) SOCKET AND SEMICONDUCTOR DEVICE PROVIDED WITH SOCKET

(75) Inventor: Yoshihiro Ihara, Nagano (JP)

(73) Assignee: Shinko Electric Industries Co., Ltd., Nagano-Shi (JP)

( * ) Notice: Subject to any disclaimer, the term of this patent is extended or adjusted under 35 U.S.C. 154(b) by 194 days.

(21) Appl. No.: 13/313,563

(22) Filed: Dec. 7, 2011

(65) Prior Publication Data

US 2012/0149249 A1 Jun. 14, 2012

(30) Foreign Application Priority Data

Dec. 14, 2010 (JP) ..... 2010-278136

(51) Int. Cl.

| | |
|---|---|
| ***H01R 4/60*** | (2006.01) |
| ***H01R 12/71*** | (2011.01) |
| ***H01R 43/02*** | (2006.01) |
| ***H01R 12/88*** | (2011.01) |
| ***H01R 13/24*** | (2006.01) |

(52) U.S. Cl.

CPC ..... *H01R 12/714* (2013.01); *H01R 43/0256* (2013.01); *H01R 12/88* (2013.01); *H01R 13/24* (2013.01)

USPC ..... 439/206; 439/66

(58) Field of Classification Search

USPC ..... 439/66, 73, 190, 205, 206, 331

See application file for complete search history.

(56) References Cited

U.S. PATENT DOCUMENTS

| | | | | |
|---|---|---|---|---|
| 4,341,432 | A * | 7/1982 | Cutchaw | 439/485 |
| 4,766,371 | A * | 8/1988 | Moriya | 324/750.05 |
| 5,248,262 | A * | 9/1993 | Busacco et al. | 439/66 |
| 5,829,988 | A * | 11/1998 | McMillan et al. | 439/70 |
| 6,067,228 | A * | 5/2000 | Li | 361/695 |
| 6,840,794 | B2 * | 1/2005 | Chiu | 439/485 |
| 6,881,070 | B2 * | 4/2005 | Chiang | 439/66 |
| 6,932,635 | B2 * | 8/2005 | Ishikawa et al. | 439/190 |
| 6,945,788 | B2 * | 9/2005 | Trout et al. | 439/66 |
| 7,094,069 | B1 * | 8/2006 | Saydam et al. | 439/70 |
| 7,220,134 | B2 * | 5/2007 | Goodman et al. | 439/70 |
| 7,264,486 | B2 | 9/2007 | Ma | |
| 7,362,584 | B2 * | 4/2008 | Millard et al. | 361/720 |
| 7,422,442 | B2 * | 9/2008 | Hsieh | 439/71 |
| 7,604,486 | B2 * | 10/2009 | Martinson et al. | 439/70 |

(Continued)

FOREIGN PATENT DOCUMENTS

| | | |
|---|---|---|
| JP | S36-28339 UM | 10/1961 |
| JP | 11-126800 | 5/1999 |

(Continued)

OTHER PUBLICATIONS

Japanese Office Action with English Translation dated Apr. 22, 2014, 7 pages.

*Primary Examiner* — Neil Abrams
*Assistant Examiner* — Travis Chambers
(74) *Attorney, Agent, or Firm* — Rankin, Hill & Clark LLP

(57) ABSTRACT

There is provided a socket. The socket includes: a wiring substrate including a first surface and a second surface opposite to the first surface; a plurality of connection terminals provided on the wiring substrate and each including a contact portion, wherein the connection terminals extend from the first surface of the wiring substrate; and a positioning member formed in a frame shape and provided on the wiring substrate to surround the connection terminals. The positioning member includes a sidewall plate having a plurality of holes formed therethrough.

17 Claims, 26 Drawing Sheets

(56) References Cited

U.S. PATENT DOCUMENTS

| | | | | |
|---|---|---|---|---|
| 8,083,529 | B2 * | 12/2011 | Ihara | 439/76.1 |
| 8,096,840 | B2 * | 1/2012 | Hironaka et al. | 439/750 |
| 8,303,331 | B2 * | 11/2012 | Yu et al. | 439/485 |
| 8,613,632 | B1 * | 12/2013 | Nichols | 439/607.21 |
| 2002/0182916 | A1 * | 12/2002 | Takahashi et al. | 439/266 |
| 2006/0189177 | A1 * | 8/2006 | Goodman et al. | 439/70 |

FOREIGN PATENT DOCUMENTS

| | | |
|---|---|---|
| JP | 2002-040097 | 2/2002 |
| JP | 2006-017738 | 1/2006 |
| JP | 2007-273233 | 10/2007 |

* cited by examiner

SOCKET AND SEMICONDUCTOR DEVICE PROVIDED WITH SOCKET

This application claims priority from Japanese Patent Application No. 2010-278136, filed on Dec. 14, 2010, the entire contents of which are herein incorporated by reference.

BACKGROUND

1. Technical Field

Embodiments described herein relate to a socket and a semiconductor device provided with the socket.

2. Related Art

Sockets to be used for electrically connecting a connection subject to a mounting board or the like are known. FIG. 1 is a sectional view of a related-art socket. As shown in FIG. 1, a socket 200 has a housing 201 which is formed by resin mold and conductive connection terminals 202 which are high in springness.

Plural through-holes 201*x* are formed through the housing 201 at a prescribed pitch. Each connection terminal 201 has contact portions 215 and 216 and a spring portion 217 which constitute an integral member, and is fixed to the wall of the associated through-hole 201*x*. The contact portion 215 is located above the upper surface of the housing 201 and the contact portion 216 is exposed in the lower surface of the housing 201.

The contact portions 216 are electrically connected to a mounting board 209 such as a mother board via respective solder balls 208. When a connection subject 205 (e.g., a wiring board or a semiconductor package) having pads 206 is pushed toward the housing 201, the contact portions 215 are brought into contact with the respective pads 206. As a result, the connection subject 205 is electrically connected to the connection terminals 202. That is, the connection subject 205 is electrically connected to the mounting board 209 such as a mother board via the connection terminals 202. (see U.S. Pat. No. 7,264,486, for example.)

Incidentally, in recent years, connection subjects 205 such as semiconductor packages have been increasing in operation speed and power consumption. As a result, a problem has arisen that a connection subject 205 such as a semiconductor package generates much heat, which is transmitted to the connection terminals 202 to make their temperatures high. The temperature of a connection subject 205 such as a semiconductor package may become as high as 100° C. If resulting heat is transmitted to the connection terminals 202, the reliability of the connections between the contact portions 216 and the solder balls 208 may be lowered.

In the configuration shown in FIG. 1, since each connection terminal 202 is fixed to the wall of the associated through-hole 201*x* of the housing 201, an air flow does not tend to be formed around each connection terminal 202. This results in a problem that heat dissipation is inefficient when the temperature of each connection terminal 202 is made high.

SUMMARY OF THE INVENTION

It is one of illustrative aspects of the present invention to provide a socket configured to increase the heat dissipation of connection terminals.

According to one or more illustrative aspects of the present invention, there is provided a socket. The socket includes: a wiring substrate including a first surface and a second surface opposite to the first surface; a plurality of connection terminals provided on the wiring substrate and each comprising a contact portion, wherein the connection terminals extend from the first surface of the wiring substrate; and a positioning member formed in a frame shape and provided on the wiring substrate to surround the connection terminals, the positioning member including a sidewall plate having a plurality of holes formed therethrough.

According to one or more illustrative aspects of the present invention, there is provided a semiconductor device. The semiconductor device includes: a mounting substrate; a socket mounted on the mounting substrate; and a semiconductor package housed in the socket and comprising a plurality of pads thereon.

The socket includes: a wiring substrate comprising a first surface and a second surface opposite to the first surface, wherein the first surface faces the semiconductor package; a plurality of connection terminals provided on the wiring substrate and each comprising a contact portion, wherein the respective connection terminals extend from the first surface of the wiring substrate to contact a corresponding one of the pads on the semiconductor package; and a positioning member formed in a frame shape and provided on the wiring substrate to surround the connection terminals. The positing member includes a sidewall plate having a plurality of holes formed therethrough. The semiconductor package is positioned by the positioning member such that the respective connection terminals face the corresponding pad on the semiconductor package.

According to one or more illustrative aspects of the present invention, there is provided a socket. The socket includes: a wiring substrate including a first surface and a second surface opposite to the first surface; a plurality of first connection terminals provided on the first surface of the wiring substrate and formed of a conductive elastic member, each of the first connection terminals including: a first contact portion; a first curved portion connected to the first contact portion; and a first fixed portion connected to the first curved portion and fixed onto the first surface of the wiring substrate; a plurality of second connection terminals provided on the second surface of the wiring substrate and formed of a conductive elastic member, each of the second connection terminals including: a second contact portion; a second curved portion connected to the second contact portion; and a second fixed portion connected to the second curved portion and fixed onto the second surface of the wiring substrate; a positioning member formed in a frame shape and provided on the wiring substrate to surround the connection terminals, the positioning member comprising a sidewall plate having a plurality of holes formed therethrough.

According to one or more illustrative aspects of the present invention, there is provided a socket. The socket includes: a first substrate including: a first surface; a second surface opposite to the first surface; and a plurality of through holes formed therethrough; a plurality of connection terminals each passing through a corresponding one of the through holes and formed of a conductive elastic member, each of the connection terminals including: a first contact portion extending from the first surface of the first substrate; a second contact portion extending from the second surface of the first substrate; a first curved portion between the first contact portion and the second contact portion; a fixed portion fixed onto the first substrate; and a second curved portion between the second contact portion and the fixed portion, and a positioning member formed in a frame shape and provided on the first substrate to surround the connection terminals, the positioning member including a sidewall plate having a plurality of holes formed therethrough.

Other aspects and advantages of the present invention will be apparent from the following description, the drawings and the claims.

DETAILED DESCRIPTION OF EXEMPLARY EMBODIMENTS

Figure 1:
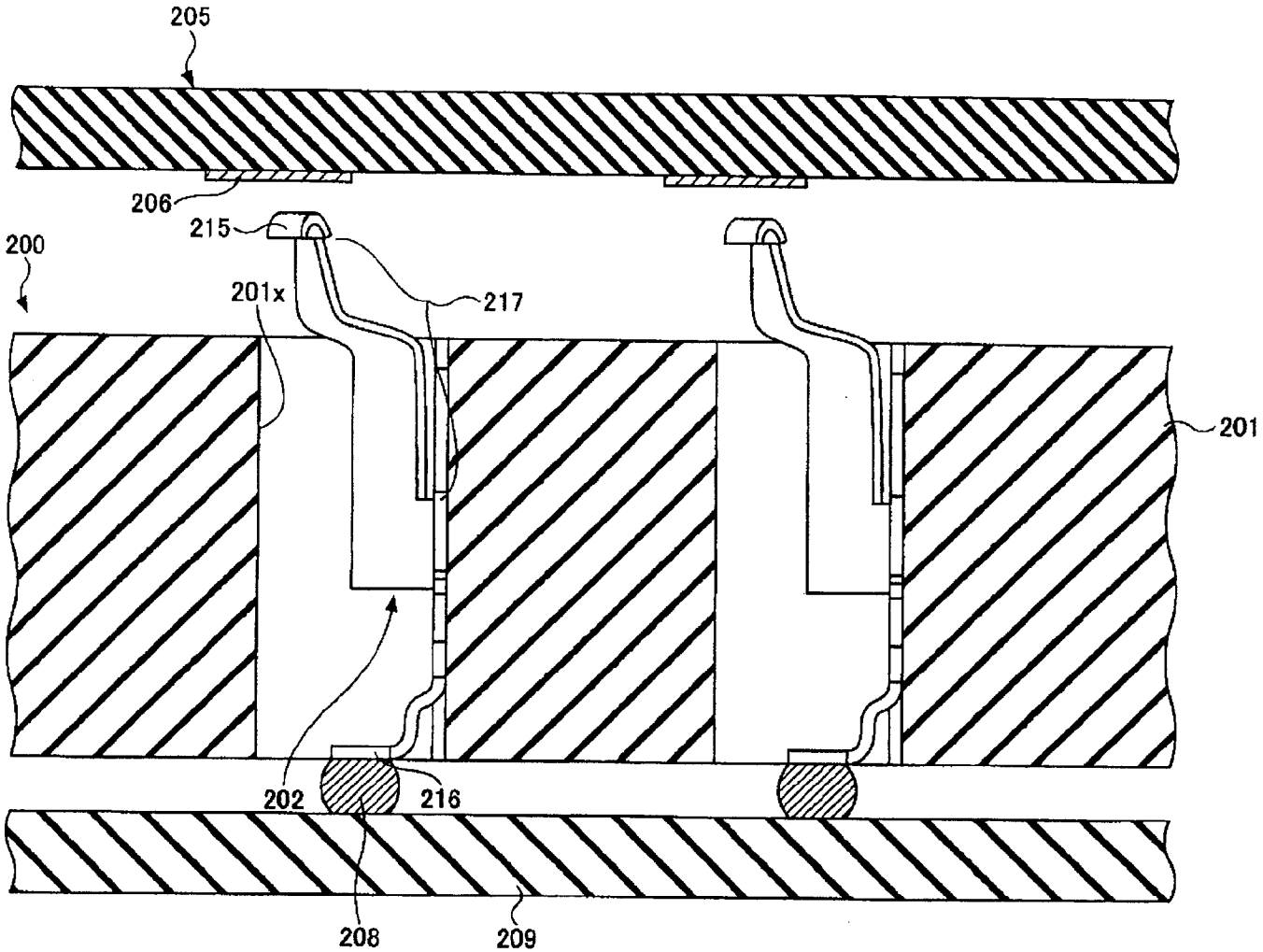
FIG. 1 is a sectional view of a related-art socket.

Hereinafter, exemplary embodiments of the present invention will be described with reference to the accompanying drawings. In all the drawings for the explanation of the embodiments, the members having the same functions are represented by the same reference numerals, and repeated description thereof will be omitted.

Although the following embodiments will be directed to an example case that a semiconductor package and a substrate(s) are each rectangular in a plan view, the shapes of the semiconductor package and the board are not limited to a rectangular shape and they may have arbitrary shapes.

Embodiment 1

Configuration of Socket According to Embodiment 1

Figure 2:
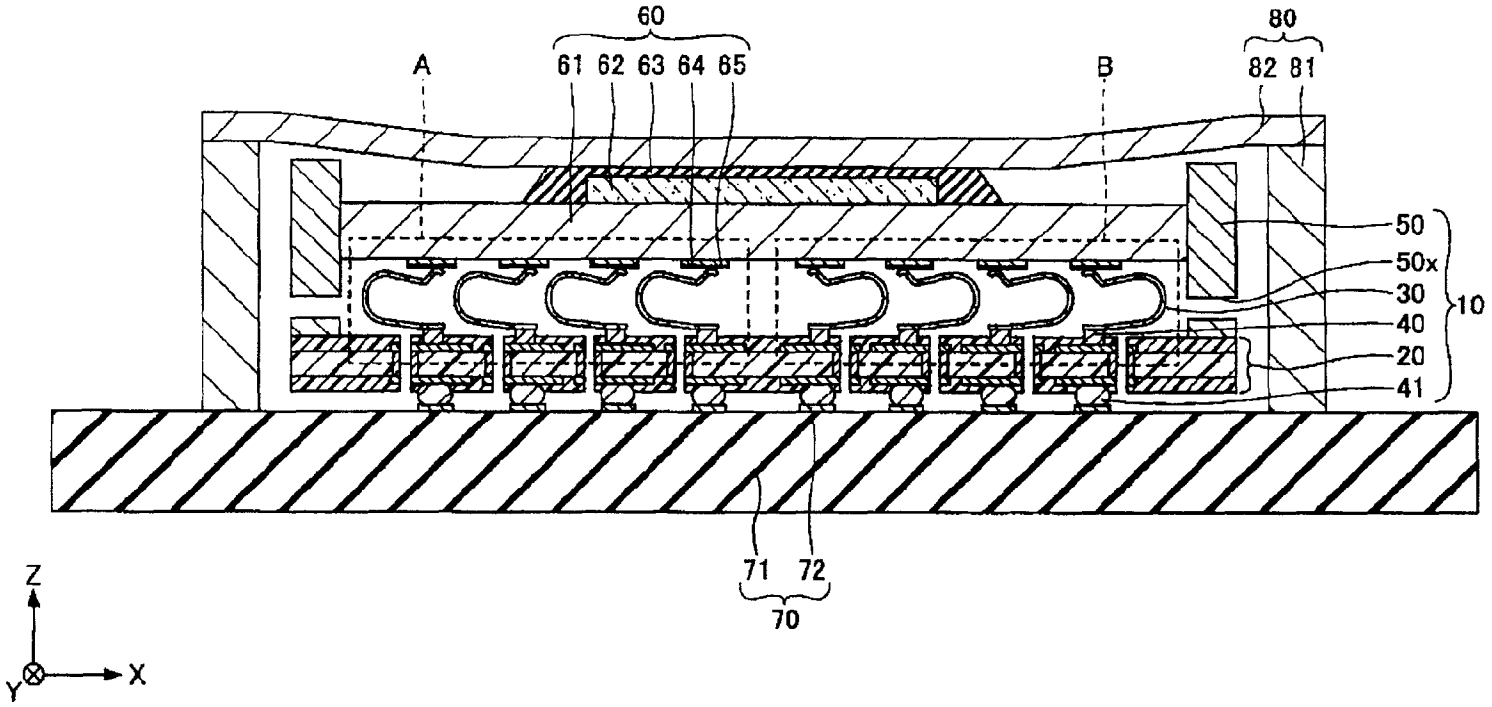
FIG. 2 is a sectional view of a socket according to a first embodiment.
Figure 3:
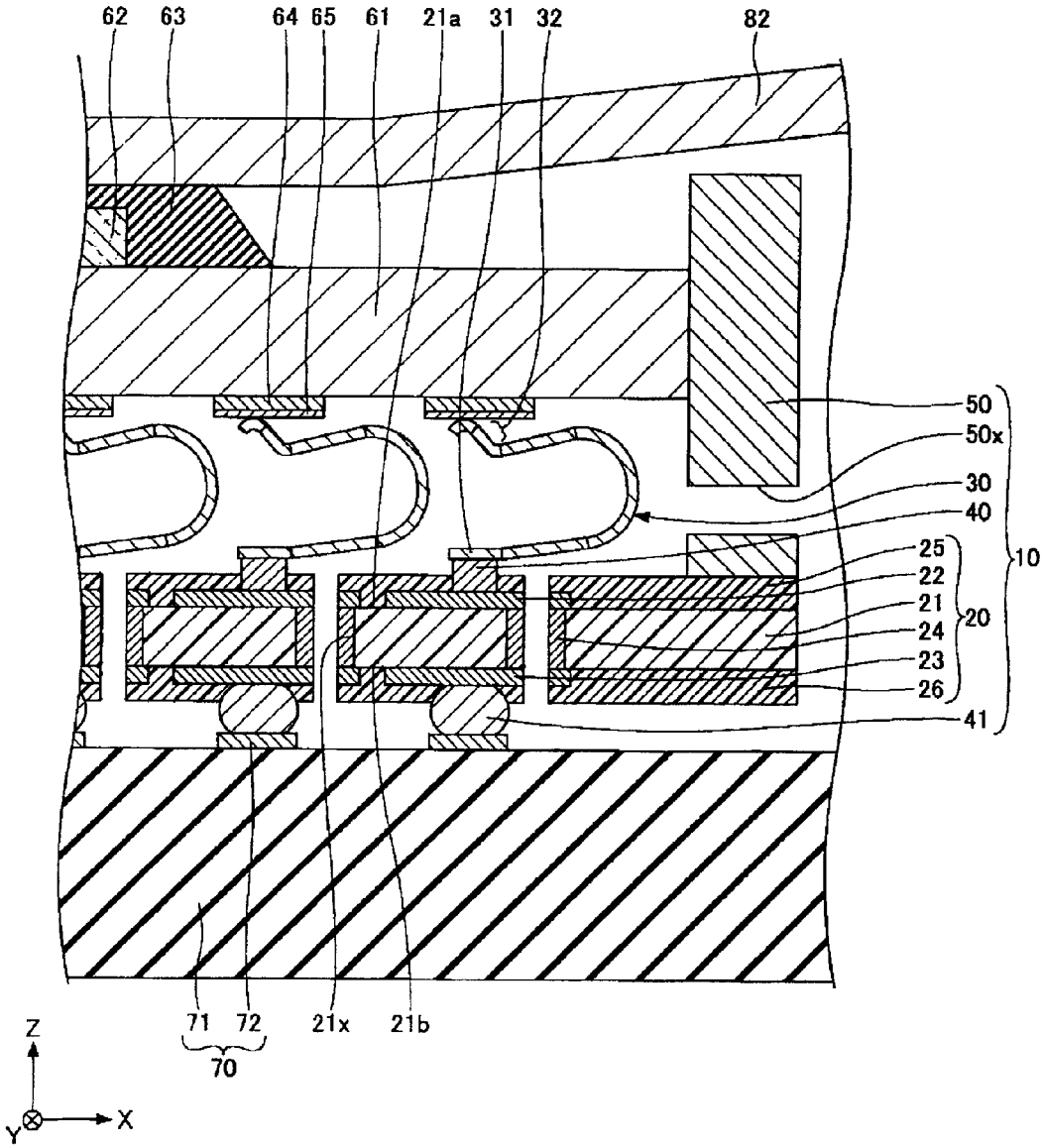
FIG. 3 is an enlarged sectional view of part of FIG. 2.
Figure 4:
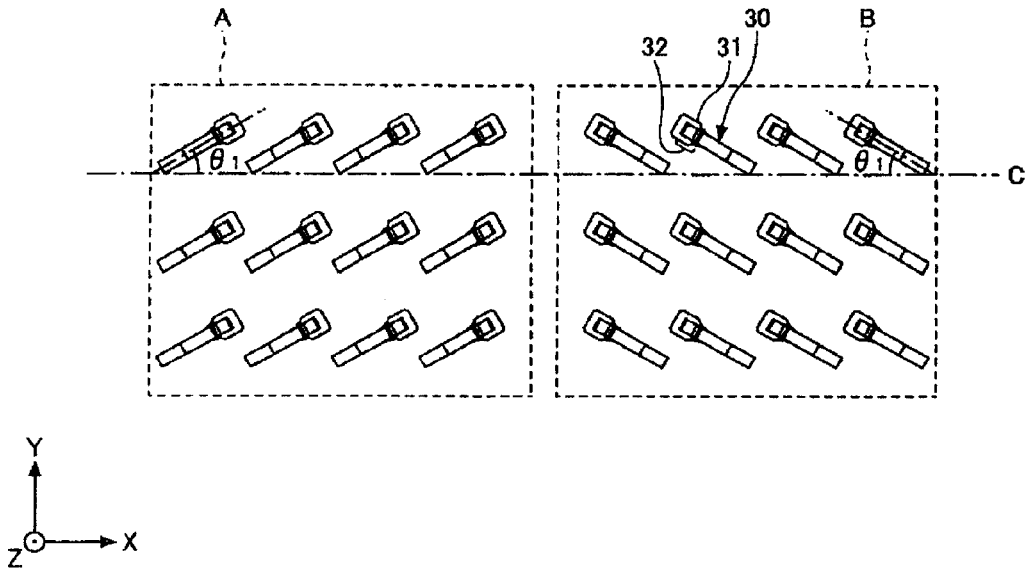
FIG. 4 is a plan view showing an arrangement of connection terminals according to the first embodiment.
Figure 5:
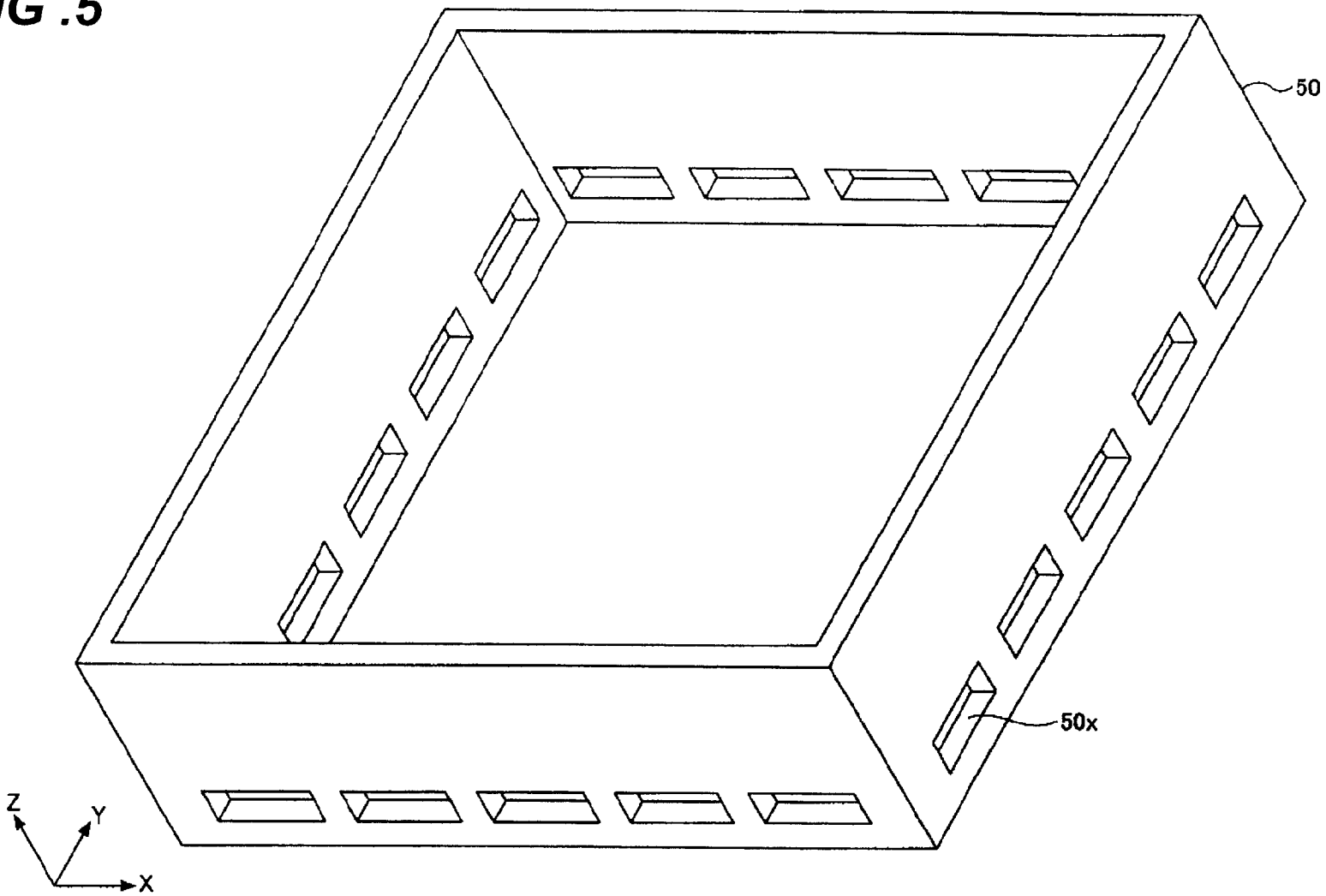
FIG. 5 is a perspective view of a positioning member in the embodiment.

FIG. 2 is a sectional view of a socket according to the first embodiment. FIG. 3 is an enlarged sectional view of part of FIG. 2. FIG. 4 is a plan view showing an arrangement of connection terminals used the first embodiment. FIG. 5 is a perspective view of a positioning member used in the embodiment. FIGS. 2 and 3 are sectional views taken parallel with the ZX plane. In FIGS. 2-5, the X direction is the arrangement direction of connection terminals 30, the Y direction is the direction that is perpendicular to the X direction and parallel with the a first surface 21*a* of a substrate body 21, and the Z direction is the direction that is perpendicular to the first surface 21*a* of the substrate body 21.

Since as shown in FIG. 4 the connection terminals 30 are inclined from the X direction in a plan view (i.e. when viewed in the Z direction), their sectional shapes cannot be shown in a sectional view taken parallel with the ZX plane. Therefore, for the sake of convenience, sectional shapes of the connection terminals 30 that should not appear in a sectional view taken parallel with the ZX plane are shown schematically in FIGS. 2 and 3.

As shown in FIGS. 2-5, the socket 10 has a wiring substrate 20, the connection terminals 30, bonding portions 40, bonding portions 41, and a positioning member 50. As described later, the bonding portions 41 are not indispensable components of the socket 10.

Reference numeral 60 denotes a semiconductor package as a connection subject, numeral 70 denotes a mounting board such as a mother board, and numeral 80 denotes a case. The semiconductor package 60 is electrically connected to the mounting board 70 via the socket 10. Although in the first embodiment the connection subject is the semiconductor package 60, in the invention the connection subject may be a wiring board or the like not having a semiconductor chip.

The wiring substrate 20 has the substrate body 21, a first conductor layer 22 formed on the first surface 21*a* of the substrate body 21, a second conductor layer 23 formed on a second surface 21*b* of the substrate body 21, via interconnections 24 formed in respective through-holes 21*x* which penetrate through the substrate body 21 between the first surface 21*a* and the second surface 21*b* of the substrate body 21, a first solder resist layer 25 formed on the first surface 21*a* of the substrate body 21 and having openings which expose portions of the first conductor layer 22, and a second solder resist layer 26 formed on the second surface 21*b* of the substrate body 21 and having openings which expose parts of the second conductor layer 23. The first conductor layer 22 and the second conductor layer 23 are wiring layers.

The interconnections of the first conductor layer 22 are electrically connected to those of the second conductor layer 23 by the via interconnections 24, respectively. The via interconnections 24 may be formed by filling in the respective through-holes 21*x*. Those portions of the first conductor layer 22 which are exposed through the openings of the first solder resist layer 25 function as pads that are connected to fixed portions 31 of the connection terminals 30, respectively. Those portions of the second conductor layer 23 which are exposed through the openings of the second solder resist layer 26 function as pads that are connected to the mounting board 70. The first surface 21*a* and the second surface 21*b* of the substrate body 21 may be referred to simply as a major surface and an opposite surface, respectively.

The substrate body 21 is a base member for supporting the connection terminals 30. The connection terminals 30 are supported in such a manner that contact portions 32 (described later) are opposed to the semiconductor package 60. For example, the substrate body 21 may be a flexible film-like substrate made of a polyimide resin, a liquid crystal polymer, or the like. Alternatively, the substrate body 21 may be a rigid substrate (e.g., FR4 substrate) formed by impregnating glass fabrics with an insulating resin such as an epoxy resin. For example, the thickness of the substrate body 21 may be about 50 to 400 μm.

The first conductor layer 22, the second conductor layer 23, and the via interconnections 24 may be made of copper (Cu) or the like. For example, the thickness of each of the first conductor layer 22 and the second conductor layer 23 may be about 10 to 30 μm. For example, the first conductor layer 22, the second conductor layer 23, and the via interconnections 24 may be formed by any of various interconnection forming methods such as a semi-additive method or a subtractive method.

The first solder resist layer 25 and the second solder resist layer 26 may be made of a photosensitive insulating resin or the like. For example, the thickness of each of the first solder resist layer 25 and the second solder resist layer 26 may be about 10 to 20 μm. For example, the first solder resist layer 25 and the second solder resist layer 26 having the openings may be formed by photolithography.

The connection terminals 30 are conductive members that are high in springness. The fixed portion 31 which is one end of each connection terminal 30 is fixed to the associated interconnection of the first conductor layer 22 via the associated bonding portion 40 and thereby connected to the associated interconnection of the first conductor layer 22 electrically and mechanically. The contact portion 32 which is the other end of each connection terminal 30 is in contact with a noble metal layer 65 of an associated pad of the semiconductor package 60 (described later) in such a manner that it can be separated from the noble metal layer 65, whereby it is electrically connected to the noble metal layer 65.

The connection terminals 30 provided in a region A are generally opposed to the connection terminals 30 provided in a region B. Arranged in this manner, the connection terminals 30 can reduce reaction force that occurs in a lateral direction (i.e., a direction other than the Z direction) when the connection terminals 30 are pressed in the Z direction. This is particularly effective in the case where the connection terminals 30 provided in a large number. However, where reaction force occurring in a lateral direction (i.e., a direction other than the Z direction) is so small as not to cause any problem as in the case where the number of connection terminals 30 is relatively small, the connection terminals 30 provided in the region A and the connection terminals 30 provided in the region B may be arranged in the same direction (refer to FIGS. 14 and 17, for example (described later)).

Each connection terminal 30 is disposed so as to be inclined from an arrangement direction C (X direction) of the connection terminals 30 by a prescribed angle $\theta_1$. However, in the embodiment, since the connection terminals 30 provided in the region A are generally opposed to the connection terminals 30 provided in the region B, as shown in FIG. 4 the connection terminals 30 provided in the region A are inclined in a different direction than the connection terminals 30 provided in the region B. For example, the prescribed angle $\theta_1$ may be set at about 25° to 35°.

Although in FIG. 4 the connection terminals 30 provided in the region A are line-symmetrical with the connection terminals 30 provided in the region B with respect to an axis of symmetry that is parallel with the Y axis, the connection terminals 30 may be disposed in a different manner. For example, in the region A, the connection terminals 30 may be disposed so as to be line-symmetrical with respect to the arrangement direction C.

Where each connection terminal 30 is disposed so as to be inclined from the arrangement direction C of the connection terminals 30, more connection terminals 30 can be disposed per unit area than in a case that each connection terminal 30 is disposed parallel with the arrangement direction C. This makes it possible to accommodate a connection subject (e.g., semiconductor package 60) in which pads (e.g., noble metal layers 65) are arranged at a narrow pitch of about 0.8 mm, for example. A detailed structure of each connection terminal 30 will be described later.

Each bonding portion 40 is formed in the associated opening of the first solder resist layer 25, and connects the fixed portion 31 of the associated connection terminal 30 to the associated interconnection of the first conductor layer 22 electrically and mechanically. The bonding portions 40 may be made of such a conductive material as solder or a conductive resin paste (e.g., Ag paste). Examples of solder as a material of the bonding portions 40 are alloys containing Pb, alloys of Sn and Cu, alloys of Sn and Ag, and alloys of Sn, Ag, and Cu.

For example, the positioning member 50 is a frame-shaped member made of metal, resin, or the like. Examples of metal as a material of the positioning member 50 are aluminum (Al) and SUS304 (stainless steel having Cr and Ni as main components: 0.08C-18Cr-8Ni). Examples of resin as a material of the positioning member 50 are a liquid crystal polymer and an epoxy resin. Although in the embodiment the positioning member 50 is a rectangular-ring-shaped member which is disposed so as to surround the connection terminals 30, the positioning member 50 may be shaped like a circular ring so as to conform to the plan-view shapes of the semiconductor package 60 and the wiring substrate 20.

The positioning member 50 has two side walls extending in the X direction and two side walls extending in the Y direction. Although the term "side walls" are used here for the sake of convenience, the four side walls may be integral with each other. Each side wall of the positioning member 50 is formed with plural holes 50*x*, whereby air flows are formed between the inside and the outside of the positioning member 50. This prevents the connection terminals 30 from becoming high in temperature because heat can be dissipated from the connection terminals 30 efficiently, even if heat generated by the semiconductor package 60 as a connection subject is transmitted to the connection terminals 30.

The lower surfaces of the side walls of the positioning member 50 are fixed to an outer peripheral portion of the surface, opposed to the semiconductor package 60, of the wiring substrate 20. More specifically, the lower surfaces of the side walls of the positioning member 50 are fixed, with adhesive or the like, to an outer peripheral portion of the first solder resist layer 25 which is formed on the first surface 21*a* of the substrate body 21. Alternatively, the positioning member 50 may be fixed to the wiring substrate 20 mechanically with screws or the like. The space that is defined by the inner side surfaces of the positioning member 50 has approximately the same plan-view shape as a wiring substrate 61 of the semiconductor package 60 (described later) to enable insertion of the semiconductor package 60.

The inner side surfaces of the positioning member 50 are in contact with the side surfaces (outer circumferential surfaces) of the wiring substrate 61 of the inserted semiconductor package 60, whereby the semiconductor package 60 and the socket 10 are positioned with respect to each other. As a result, the noble metal layers 65 of the semiconductor package 60 are made in contact with the contact portions 32 of the connection terminals 30 of the socket 10, respectively. The positioning member 50 has a function of increasing the strength of the wiring substrate 20 in addition to the function of positioning the semiconductor package 60 and the socket 10 with respect to each other.

An alternative configuration is possible in which the positioning member 50 is omitted and the semiconductor package 60 is positioned by, for example, a frame portion 83 of a case 80 (described later). This will be described later with reference to FIGS. 12, 14, and 17.

Each bonding portion 41 is formed in the associated opening of the second solder resist layer 26, and connects the associated interconnection of the second conductor layer 23 of the wiring substrate 20 to the associated conductor layer 72 (pad) of the mounting board 70 electrically and mechanically. The bonding portions 41 may be made of such a conductive material as solder or a conductive resin paste (e.g., Ag paste). Examples of solder as a material of the bonding portions 41 are alloys containing Pb, alloys of Sn and Cu, alloys of Sn and Ag, and alloys of Sn, Ag, and Cu.

The bonding portions 41 are not indispensable components of the socket 10. An alternative configuration is possible in which the bonding portions 41 of the socket 10 are omitted and bumps made of solder or a conductive resin adhesive are formed on the respective conductor layers 72 of the mounting board 70.

Next, the semiconductor package 60 as a connection subject, the mounting board 70 such as a mother board, and the case 80 will be described. The semiconductor package 60 as a connection subject has the wiring substrate 61, a semiconductor chip 62, a sealing resin member 63, conductor layers 64, and the noble metal layers 65. The conductor layers 64 and the noble metal layers 65 are wiring layers, and each set of a conductor layer 64 and a noble metal layer 65 constitutes a pad.

For example, the wiring substrate 61 is configured in such a manner that insulating layers, wiring patterns, via interconnections, etc. (not shown) are formed on or through a substrate body which contains an insulating resin. The semiconductor chip 62 made of silicon or the like is mounted on one surface of the wiring substrate 61 and the conductor layers 64 which are part of wiring patterns are formed on the other surface of the wiring substrate 61.

The conductor layers 64 are made of copper (Cu) or the like. For example, the thickness of the conductor layers 64 is about 10 to 30 μm. For example, the semiconductor chip 62 is flip-chip-bonded to the wiring substrate 61 and sealed by the sealing resin member 63 made of an insulating resin. An alternative structure is possible in which the sealing resin member 63 is formed so as to expose the back surface of the semiconductor chip 62 and the back surface of the semiconductor chip 62 is provided with a radiation plate made of copper (Cu) or the like.

The noble metal layers 65 are laid on the upper surfaces of the conductor layers 64, respectively. The sets of a conductor layer 64 and a noble metal layer 65 are pads formed on the other surface of the wiring substrate 61 so as to be arranged in lattice form, for example. The semiconductor package 60 is what is called an LGA (land grind array) and the socket 10 is what is called an LGA socket.

The noble metal layers 65 may be layers containing a noble metal such as gold (Au), palladium (Pd), or the like. The noble metal layers 65 may be formed by electroless plating or the like. A nickel (Ni) layer, an Ni/Pd layer (i.e., a metal layer formed by laying an Ni layer and a Pd layer in this order), or the like may be formed as an underlying layer of a gold (Au) layer.

The noble metal layers 65 are provided to increase the reliability of the connection to the connection terminals 30. To stabilize the contact resistance of the contact with the connection terminals 30, the noble metal layers 65 are much thicker than ordinary gold plating layers etc. The thickness of gold plating layers etc. that are usually provided to increase the reliability of the connection to solder balls etc. are about 0.05 μm or less. In contrast, for example, the thickness of the noble metal layers 65 is about 0.4 μm, that is, eight times or more as great as that of ordinary gold plating layers etc.

The mounting board 70 such as a mother board has a substrate body 71 and the conductor layers 72. The conductor layers 72 are formed on one surface of the substrate body 71. The conductor layers 72 are wiring layers and serve as pads. For example, the substrate body 71 is formed by impregnating glass fabrics with an insulating resin such as an epoxy resin. The conductor layers 72 are made of copper (Cu) or the like.

The case 80 has a frame portion 81 and a lid 82. The frame portion 81 is a frame-shaped member and is disposed outside the outer surfaces of the positioning member 50. It is preferable that the frame portion 81 be made of a rigid metal, resin, or the like. The frame portion 81 is fixed to the upper surface of the mounting board 70 with bolts (not shown) that penetrate through the mounting board 70.

Each of the side walls of the frame portion 81 may be formed with plural holes like the holes 50*x* of the positioning member 50, in which case the air around the connection terminals 30 tend to flow more easily and the heat dissipation of the connection terminals 30 is thereby increased further. Furthermore, it is possible to provide, in the vicinity of the socket 10, a cooling fan for sending air and a structure which allows air that is sent from the cooling fan to flow into and out of the inside space through the holes that are formed through the side walls of the frame portion 81 and the positioning member 50.

The lid 82 is a member which is generally rectangular or generally frame-shaped in a plan view and is made of metal, resin, or the like. For example, the lid 82 is attached to one end of the upper surface of the frame portion 81 so as to be rotatable, and has a lock mechanism at the other end. When an outer peripheral portion of the lid 82 is fixed (locked) so as to come into contact with the upper surface of the frame portion 81 (the state of FIGS. 2 and 3), the lid 82 presses the semiconductor package 60 toward the mounting board 70, whereby the semiconductor package 60 is moved toward the mounting board 70.

As a result, the connection terminals 30 of the socket 10 are pressed and contracted in the Z direction to generate prescribed print pressure and the noble metal layers 65 of the semiconductor package 60 come into contact with the contact portions 32 of the connection terminals 30, respectively. That is, the semiconductor package 60 is electrically connected to the mounting board 70 via the socket 10. The semiconductor package 60 can be detached from the socket 10 by unlocking the lid 82.

The frame portion 81 and the lid 82 may be separate members. In this case, it suffices that the case 80 have a structure that the lid 82 can be fixed to the frame portion 81 when the semiconductor package 60 is pressed by the lid 82 from above.

Figure 6A:
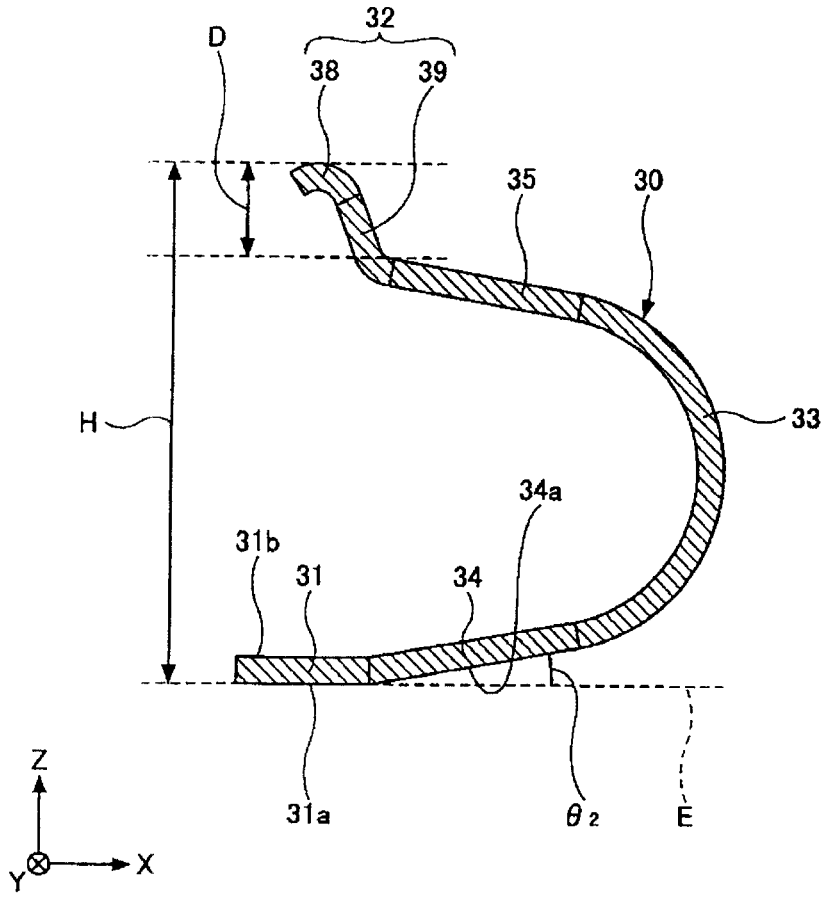
FIG. 6A is a sectional view of each connection terminal in the first embodiment.
Figure 6B:
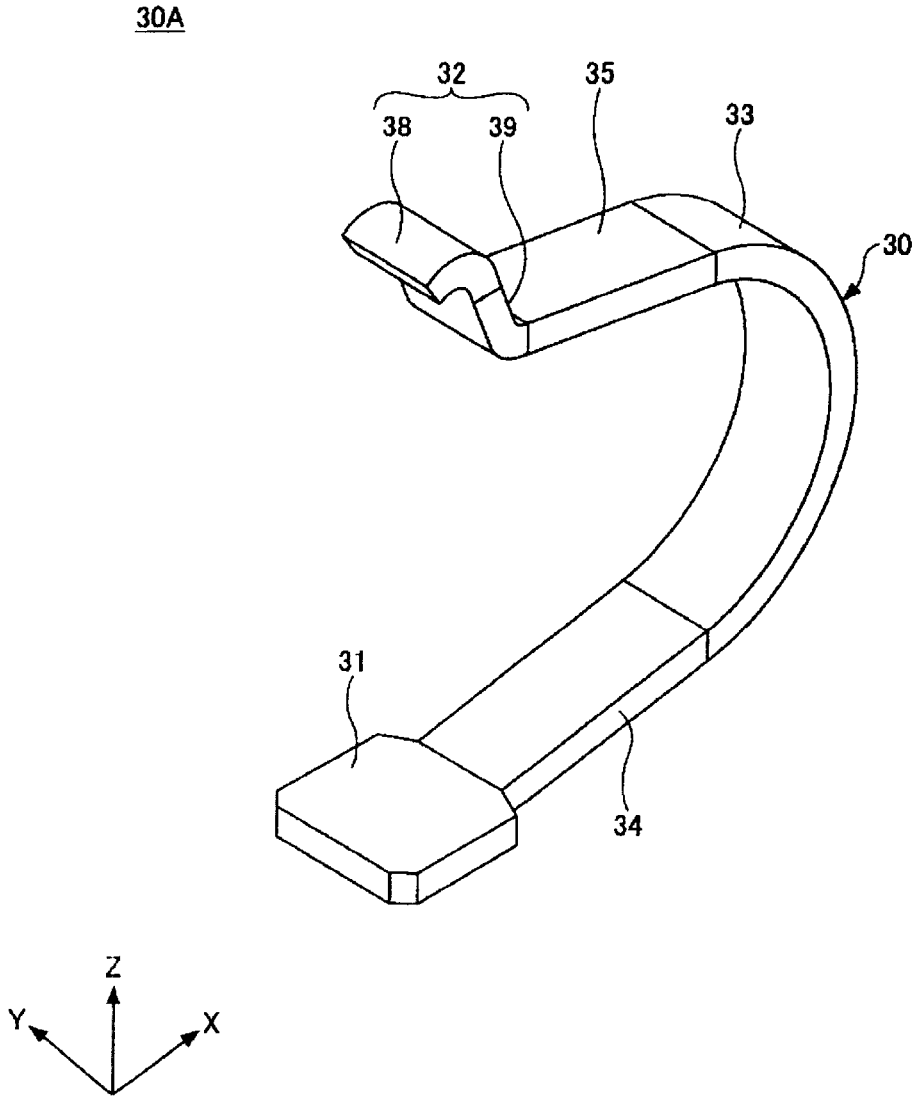
FIG. 6B is a perspective view of each connection terminal in the first embodiment.

A detailed structure of each connection terminal 30 will now be described with reference to FIGS. 6A and 6B. FIGS. 6A and 6B are a sectional view and a perspective view, respectively, of each connection terminal 30 used in the first embodiment. As shown in FIGS. 6A and 6B, each connection terminal 30, which is a conductive member that is high in springness, has the fixed portion 31, the contact portion 32, a spring portion 33, a first support portion 34, and a second support portion 35.

The fixed portion 31 is one end portion of the connection terminal 30 and is shaped like a flat plate. For example, the thickness (in the Z direction) of the fixed portion 31 may be about 0.08 mm. For example, the width of the fixed portion 31 may be about 0.3 mm. For example, the longitudinal length of the fixed portion 31 may be about 0.4 mm.

A first surface 31*a* of the fixed portion 31 is connected electrically and mechanically to the surface of the associated interconnection of the first conductor layer 22 of the wiring substrate 20 via the associated bonding portion 40.

The contact portion 32 is the other end portion of the connection terminal 30 and is opposed to the fixed portion 31. The contact portion 32 is electrically connected to the fixed portion 31 via the spring portion 33, the first support portion 34, and the second support portion 35. The contact portion 32 has a tip portion 38 and a rise portion 39. For example, the thickness of the contact portion 32 may be about 0.08 mm. For example, the width of the contact portion 32 may be about 0.2 mm. The spring portion 33, the first support portion 34, and the second support portion 35 may together be called a curved portion of the connection terminal 30. That is, the connection terminal 30 has the fixed portion 31 which is opposed to the contact portion 32 and electrically connected to the contact portion 32 via the curved portion which is high in springness.

The tip portion 38 is a portion to contact the noble metal layer 65 of the associated pad of the semiconductor package 60 (connection subject). The tip portion 38 has a round shape and is moved mainly in the Z direction when the connection terminal 30 is pressed. Since the tip portion 38 has a round shape, the noble metal layer 65 are prevented from being damaged by the tip portion 38 when the tip portion 38 is pressed and comes into contact with the noble metal layer 65.

When the contact portion 32 is pressed by the semiconductor package 60, the tip portion 38 is kept in contact with the noble metal layer 65 as the contact portion 32 is moved in such a direction (Z direction) as to come closer to the fixed portion 31 because of deformation of the spring portion 33. As a result, while kept in contact with the noble metal layer 65, the contact portion 32 is not moved by a long distance parallel with the surface where the noble metal layers 65 are formed. This makes it possible to arrange the noble metal layers 65 at a narrow pitch. For example, the pitch of the noble metal layers 65 (i.e., the pitch of the tip portions 38) may be set at about 0.8 to 1.5 mm.

One end portion of the rise portion 39 is integral with the second support portion 35 and the other end portion of the rise portion 39 is integral with the tip portion 38. The rise portion 39 projects from the second support portion 35 toward the noble metal layer 65 (i.e., away from the fixed portion 31).

The rise portion 39 which exists between the tip portion 38 and the second support portion 35 so as to be integral with them and projects from the second support portion 35 toward the noble metal layer 65 (i.e., away from the fixed portion 31) provides the following advantage. When the tip portion 38 is pressed by the semiconductor package 60, the second support portion 35 is prevented from contacting the noble metal layer 65 because of deformation of the spring portion 33 and hence the connection terminal 30 and the noble metal layer 65 are prevented from being damaged.

The projection length D of the contact portion 32 from the connecting position of the rise portion 39 and the second support portion 35 in a state that the contact portion 32 is not in contact with the noble metal layer 65 may be 0.3 mm, for example.

The spring portion 33 exists between the first support portion 34 and the second support portion 35 so as to be integral with them. The spring portion 33 is curved (in a C shape, for example) and is high in springness.

The spring portion 33 serves to bring the contact portion 32 into contact with the noble metal layer 65 instead of fixing them to each other by urging the contact portion 32 toward the noble metal layer 65 through reaction when the contact portion 32 is pressed by the semiconductor package 60. For example, the width and the thickness of the spring portion 33 may be set the same as those of the contact portion 32.

In the connection terminal 30 used in the embodiment, actually, the first support portion 34, the spring portion 33, the second support portion 35, and the contact portion 32 together function as a spring. The spring constant of the portion consisting of the first support portion 34, the spring portion 33, the second support portion 35, and the contact portion 32 of the connection terminal 30 may be set at 0.6 to 0.8 N/mm, for example.

The first support portion 34 exists between the spring portion 33 and the fixed portion 31. One end portion of the first support portion 34 is integral with the spring portion 33 and the other end portion of the first support portion 34 is integral with the fixed portion 31. The first support portion 34 is shaped like a flat plate.

The first support portion 34 is formed in such a manner that the angle $\theta_2$ formed by a plane E containing the first surface 31*a* of the fixed portion 31 and a surface 34*a* of the first support portion 34 becomes an acute angle $\theta_2$, which may be set at 5° to 15°, for example.

Setting the angle $\theta_2$ at an acute angle prevents the first support portion 34 from contacting the wiring substrate 20 because of deformation of the spring portion 33 and hence prevents the connection terminal 30 and the wiring substrate 20 from being damaged when the tip portion 38 is pressed by the semiconductor package 60. For example, the width and the thickness of the first support portion 34 may be set the same as those of the contact portion 32.

The second support portion 35 exists between the spring portion 33 and the contact portion 32. One end portion of the second support portion 35 is integral with the spring portion 33 and the other end portion of the second support portion 35 is integral with the rise portion 39 of the contact portion 32. The second support portion 35 is shaped like a flat plate. For example, the width and the thickness of the second support portion 35 may be set the same as those of the contact portion 32.

For example, the height H of the connection terminal 30 in a state shown in FIG. 6A (i.e. a state that the contact portion 32 of the connection terminal 30 is not pressed) may be set at about 1 to 2 mm. It is preferable that the height H be set at about 1.6 mm.

For example, the connection terminals 30 may be manufactured in the following manner. A metal sheet (not shown) made of a Cu-based alloy, for example, is prepared and punched to produce metal plates having a prescribed shape (e.g., long and narrow shape). Then, Ni plating films (thickness: 1 to 3 μm, for example) are formed on the entire surfaces of each of the resulting metal plates. Then, Au plating films (thickness: 0.3 to 0.5 μm, for example) are laid on the Ni plating films of portions to become a fixed portion 31 and a tip portion 38. A connection terminal 30 is completed by bending a metal plate that is formed with the Ni plating films and the Au plating films.

Example Cu-based alloys as materials of the metal sheet are phosphor bronze, beryllium copper, and Colson Cu-based alloys. Alternatively, the connection terminals 30 may be manufactured by etching a metal sheet (not shown) made of a Cu-based alloy, for example, into metal plates having a prescribed shape and bending each of the resulting metal plates.

[How to Use Socket According to Embodiment 1]

Next, a method for connecting the semiconductor package 60 to the mounting substrate 70 using the socket 10 will be described with reference to FIGS. 7-9.

Figure 7:
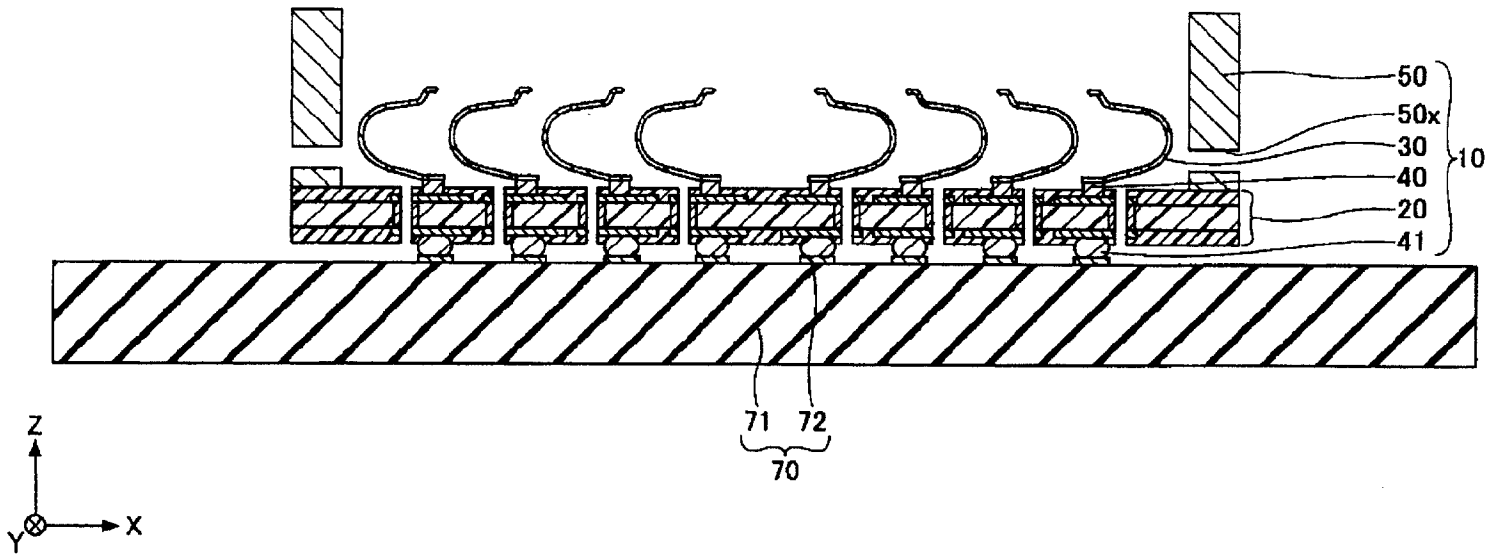
FIG. 7 is a first view showing a connection method using the socket according to the first embodiment.

First, as shown in FIG. 7, the mounting board 70 and the socket 10 are prepared. The socket 10 is connected to the mounting board 70 electrically and mechanically by joining them together through the bonding portions 41. More specifically, first, the bonding portions 41 of the socket 10 are brought into contact with the conductor layers 72 of the mounting board 70. Then, the bonding portions 41 are melted by heating them to 230° C., for example, and then cured, whereby the socket 10 is joined to the mounting board 70. As a result, the socket 10 is connected to the mounting board 70 electrically and mechanically through the bonding portions 41.

Figure 8:
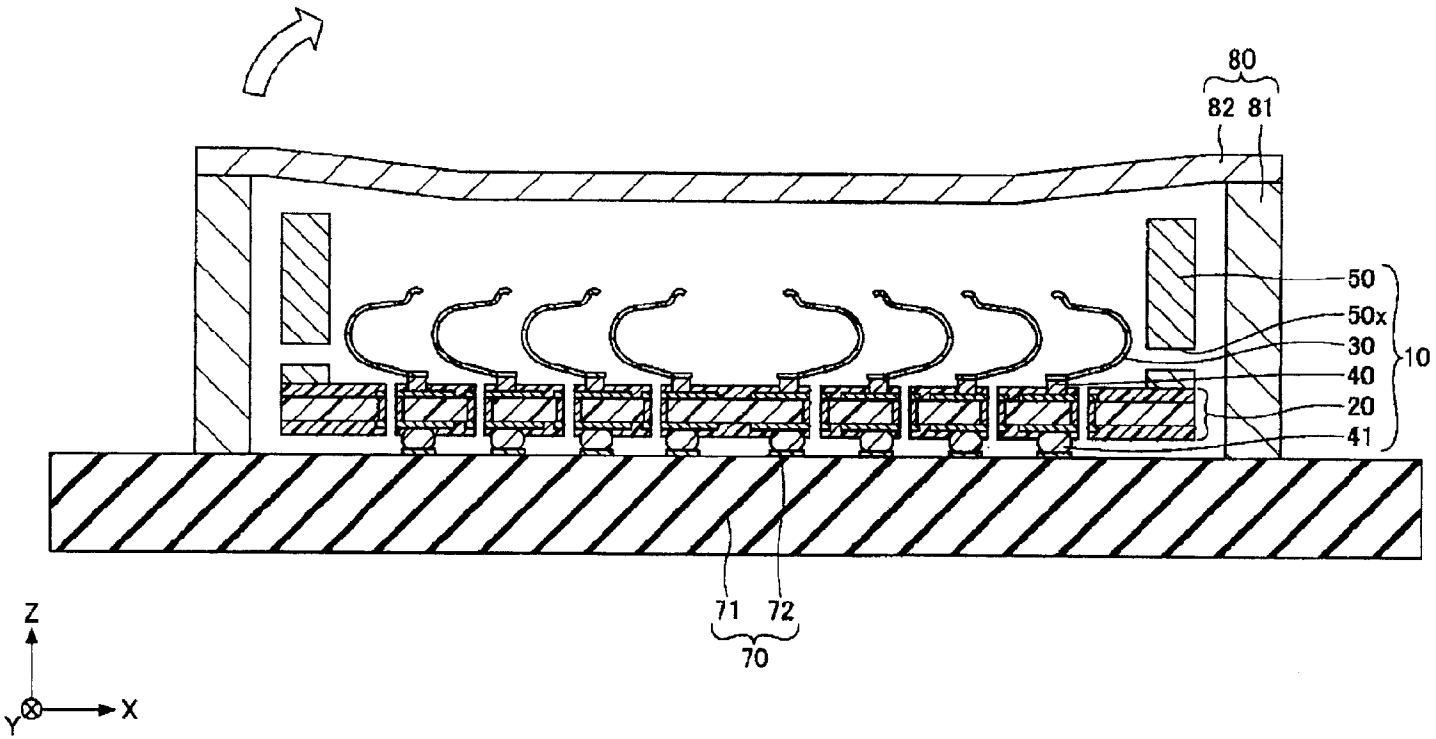
FIG. 8 is a second view showing the connection method using the socket according to the first embodiment.

Then, as shown in FIG. 8, the case 80 is prepared. The frame portion 81 of the case 80 is fixed to the upper surface of the mounting board 70 with bolts or the like (not shown) that penetrate through the mounting board 70. Then, the lid 82 of the case 80 is rotated in the direction indicated by an arrow to establish a state that the semiconductor package 60 can be inserted.

Figure 9:
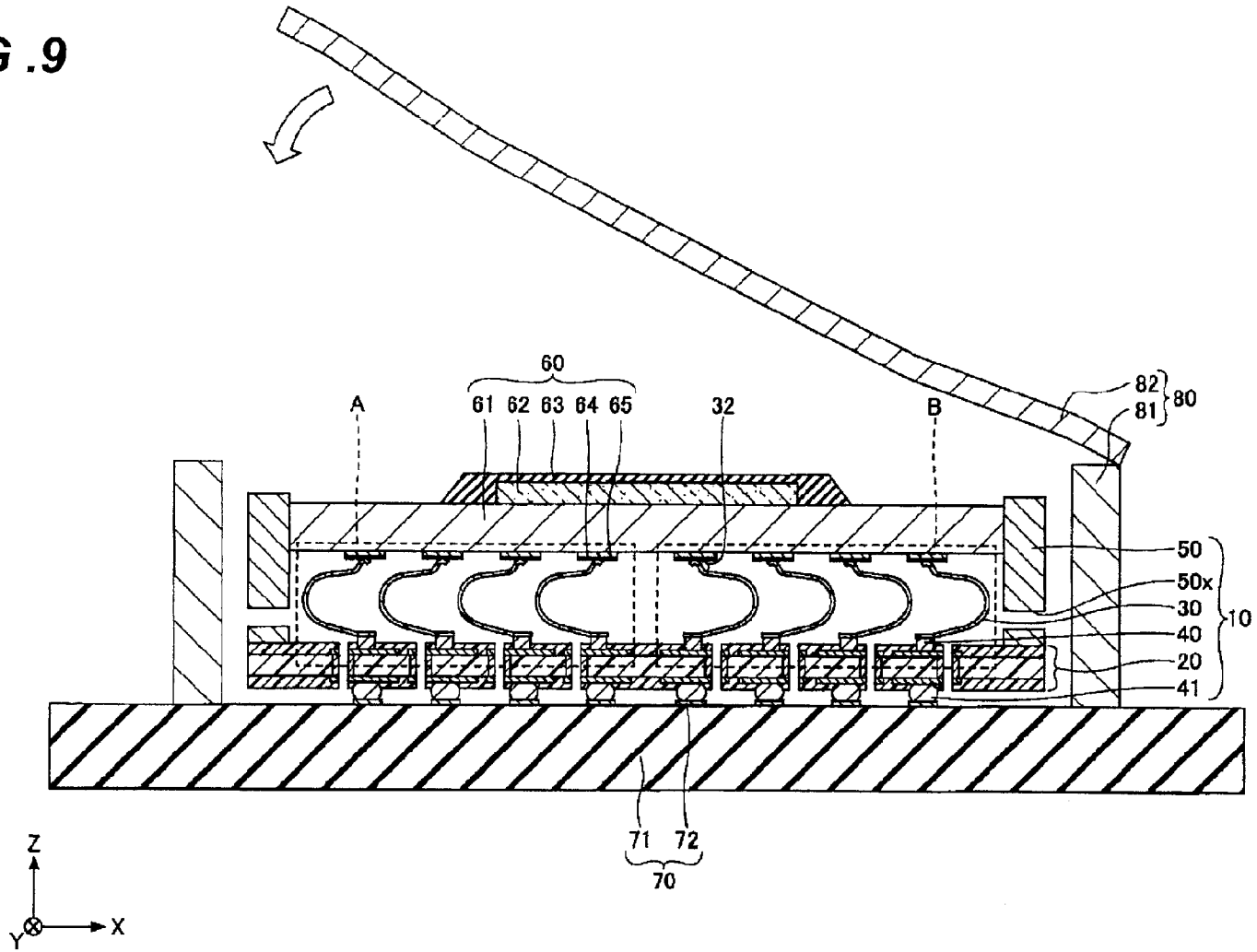
FIG. 9 is a third view showing the connection method using the socket according to the first embodiment.

Then, as shown in FIG. 9, the semiconductor package 60 is prepared. The semiconductor package 60 is inserted into the positioning member 50 and placed so that the side surfaces (outer circumferential surfaces) of the wiring substrate 61 come into contact with the inner surfaces of the positioning member 50. At this time, the connection terminals 30 are not pressed yet. The semiconductor package 60 is positioned with respect to the socket 10 through the positioning member 50 and the noble metal layers 65 of the semiconductor package 60 come into contact with the contact portions 32 of the connection terminals 30, respectively.

Then, the lid 82 is rotated in the direction indicated by an arrow, whereby the semiconductor package 60 is pressed toward the mounting board 70. The outer peripheral portion of the lid 82 is fixed (locked) so as to come into contact with the upper surface of the frame portion 81. As a result, the connection terminals 30 are pressed and contracted in the Z direction to generate prescribed print pressure and the noble metal layers 65 of the semiconductor package 60 are electrically connected to the contact portions 32 of the connection terminals 30, respectively. That is, the semiconductor package 60 is electrically connected to the mounting board 70 via the socket 10 (see FIGS. 2 and 3).

As described above, in the socket 10 according to the first embodiment, the plural connection terminals 30 are provided on the wiring substrate 20 in such a manner that each connection terminal 30 is not enclosed by resin or the like and the plural holes 50*x* are formed through each side wall of the positioning member 50 for positioning the wiring substrate 20. With these features, air flows between the inside and the outside of the positioning member 50. For example, air that flows into the internal space of the positioning member 50 through the holes 50*x* of one side wall of the positioning member 50 takes heat from the individual connection terminals 30 and flows out through the holes 50*x* of the other side walls. The heat dissipation of each connection terminal 30 is thus increased. That is, the connection terminals 30 are prevented from becoming high in temperature because heat can be dissipated from the connection terminals 30 efficiently, even if heat generated by the semiconductor package 60 as a connection subject is transmitted to the connection terminals 30. The dissipation of heat that is generated from the back surface (i.e. the surface on the side of the conductor layers 64) of the semiconductor package 60 is also increased, which prevents the semiconductor package 60 from becoming high in temperature.

The structure that the plural connection terminals 30 are provided on the wiring substrate 20 in such a manner that each connection terminal 30 is not enclosed by resin or the like can suppress warping of the socket 10 and thereby increase the reliability of the connection between the semiconductor package 60 and mounting board 70.

The wiring substrate 20 is made of the same material as the mounting board 70 such as a mother board. Since they have the same thermal expansion coefficient, even if the mounting board 70 is warped, the wiring substrate 20 is warped in the same direction as the mounting board 70. This contributes to increase of the reliability of the connection between the wiring substrate 20 and the mounting board 70.

Embodiment 2

A second embodiment is different from the first embodiment in that the wiring substrate 20 used in the first embodiment is replaced by a substrate 90 which is different in structure than the wiring substrate 20. In the second embodiment, components having the same components in the first embodiment will not be described in detail. In the second embodiment, the height of the side walls of the positioning member 50 and the positions of the holes 50*x* are different than in the first embodiment and can be determined as appropriate according to the structures of the substrate 90 and the connection terminals 30.

Figure 10:
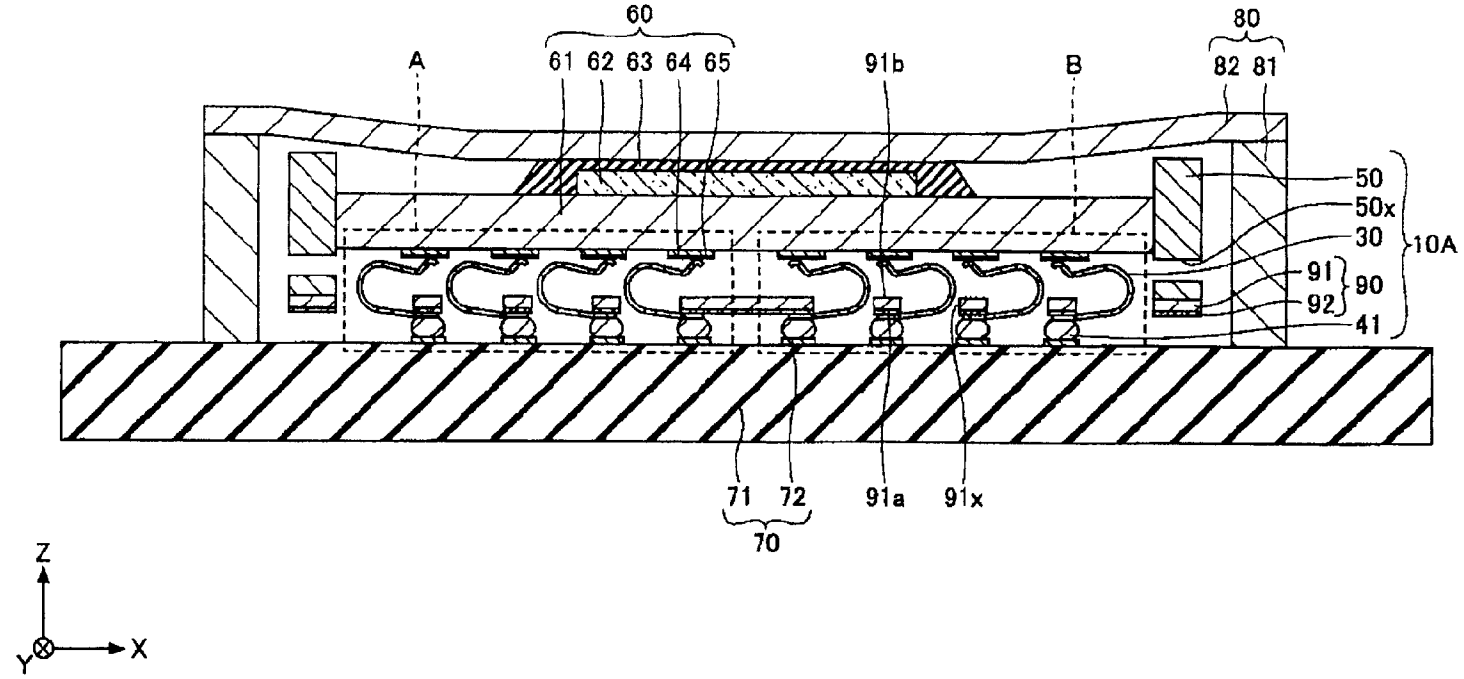
FIG. 10 is a sectional view of a socket according to a second embodiment.
Figure 11:
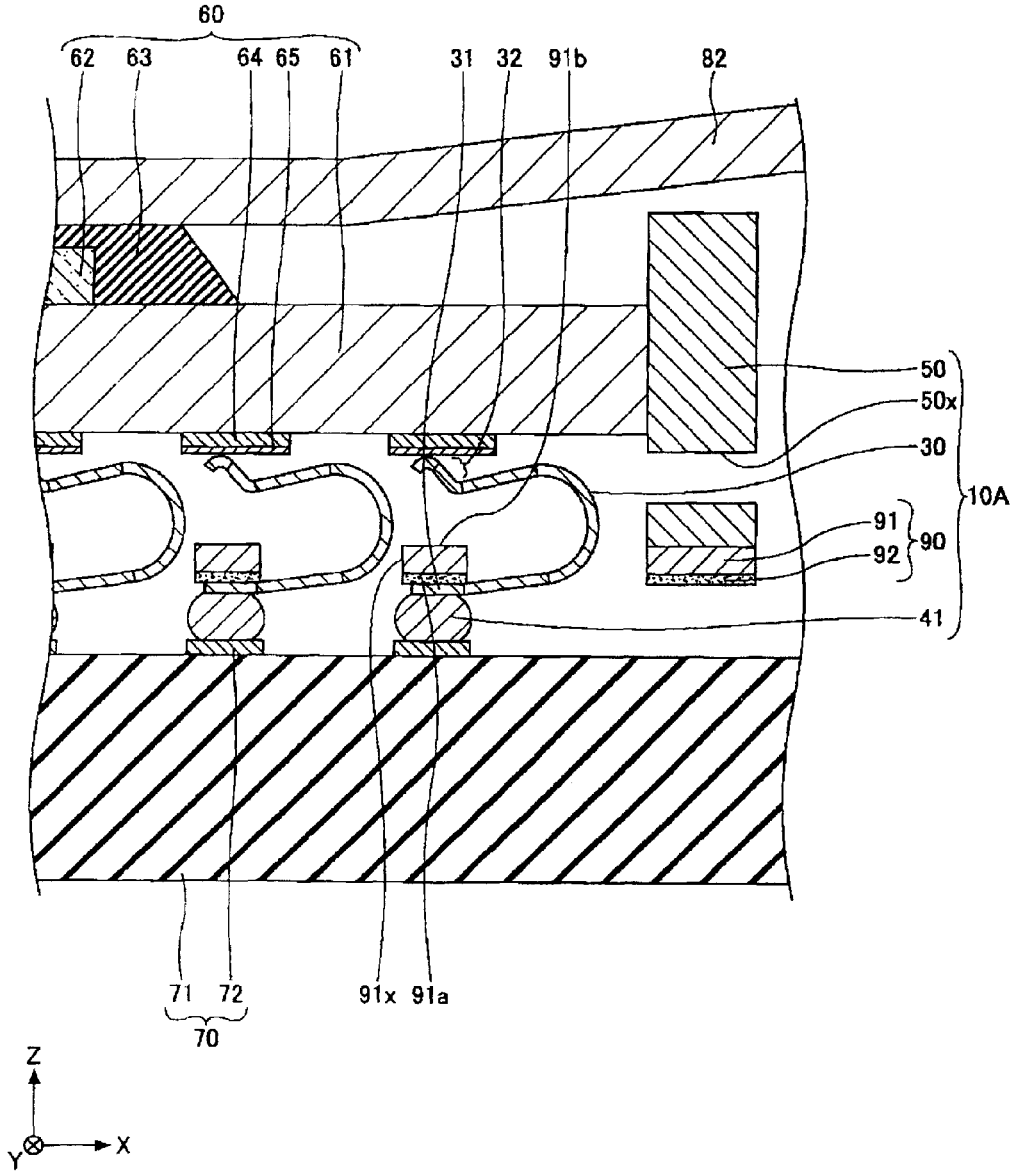
FIG. 11 is an enlarged sectional view of part of FIG. 10.

FIG. 10 is a sectional view of a socket 10A according to the second embodiment. FIG. 11 is an enlarged sectional view of part of FIG. 10. As shown in FIGS. 10 and 11, the socket 10A is different from the socket 10 (see FIGS. 2 and 3) in that the wiring substrate 20 is replaced by the substrate 90.

The substrate 90 has a substrate body 91 which is formed with through-holes 91*x* and an adhesive layer 92 which is formed on one surface 91*a* of the substrate body 91. For example, the substrate body 91, which is a base member to which the connection terminals 30 are fixed, may be a flexible film-like substrate made of a polyimide resin, a liquid crystal polymer, or the like. Alternatively, the substrate body 91 may be a rigid substrate (e.g., FR4 substrate) formed by impregnating glass fabrics with an insulating resin such as an epoxy resin. For example, the thickness of the substrate body 91 may be about 50 to 400 μm.

The through-holes 91*x* are holes through which the respective connection terminals 30 are inserted, and is formed in the same number as the number of noble metal layer 65 (pads) of the semiconductor package 60 (connection subject). The plan-view shape of each through-hole 91*x* may be determined according to that of each connection terminal 30, and may be rectangular, for example. The substrate body 91 (including the insides of the through-holes 91*x*) is not provided with any conductors such as wiring patterns or via interconnections.

The adhesive layer 92, which is a layer to bond the connection terminals 30 to the substrate body 91, is formed on the surface 91*a* of the substrate body 91. The adhesive layer 92 may be made of a thermosetting epoxy, silicone, or like adhesive, a thermoplastic adhesive such as a liquid crystal polymer, or the like.

It is preferable that the adhesive layer 92 be made of a material that does not melt even when, for example, it is heated in a solder reflow process or the like of a manufacturing process of the socket 10A or its temperature is made high due to, for example, an ambient temperature of the socket 10A. The adhesive layer 92 may be formed on either the entire surface 91*a* of the substrate body 91 or only those portions of the surface 91*a* of the substrate body 91 to which the respective connection terminals 30 are to be bonded and their neighborhoods.

The connection terminals 30 are inserted in the respective through-holes 91*x* of the substrate body 91 and the second surfaces 31*b* of the fixed portions 31 (see FIG. 6A) are bonded to the surface 91*a* (i.e., the surface not opposed to the semiconductor package 60) of the substrate body 91 via the adhesive layer 92. The contact portions 32 of the connection terminals 30 are located above the other surface 91*b* (i.e., the surface opposed to the semiconductor package 60) of the substrate body 91. Each connection terminal 30 is inserted in the associated through-hole 91*x* in a state that it can function as a spring. That is, that portion of each connection terminal 30 which is inserted in the associated through-hole 91*x* is not fixed to the inner surfaces of the through-hole 91*x* and hence can be deformed elastically. Therefore, almost all of each connection terminal 30 (excluding the fixed portion 31 and including its portion that is inserted in the through-hole 91*x*) can function as a spring.

The first surface 31*a* (see FIG. 6A) of the fixed portion 31 of each connection terminal 30 is joined to the associated conductor layer 72 (pad) of the mounting board 70 via the associated bonding portion 41 and thereby connected to the associated conductor layer 72 electrically. That is, the first surface 31*a* of the fixed portion 31 of each connection terminal 30 is a surface to be connected to the mounting board 70 as an external member. The contact portion 32 of each connection terminal 30 is in contact with the associated noble metal layer 65 in such a manner that it can be separated from the noble metal layer 65 (i.e., it is not fixed to the noble metal layer 65), and is thereby connected to the noble metal layer 65 electrically.

As described above, in the socket 10A according to the second embodiment, the plural connection terminals 30 are provided on the substrate 90 in such a manner that each connection terminal 30 is not enclosed by resin or the like and the plural holes 50*x* are formed through each side wall of the positioning member 50 for positioning the substrate 90. These features provide the same advantages as the similar features of the first embodiment.

The through-holes 91*x* are formed through the substrate 90, each connection terminal 30 is inserted in the associated through-hole 91*x* in a state that it can function as a spring (i.e. it is not fixed to the inner surfaces of the through-hole 91*x*), and the fixed portion 31 of each connection terminal 30 is bonded to the one surface 91*a* of the substrate 90 while the contact portion 32 is located above the other surface 91*b* of the substrate 90. With these features, in the vertical direction the substrate 90 extends within the height range of the connection terminals 30 and hence the thickness of the substrate 90 is not a factor in preventing height reduction of the socket 10A. Furthermore, since almost all of each connection terminal 30 including the portion that is inserted in the associated through-hole 91*x* functions as a spring, each connection terminal 30 itself can be made lower than each of the conventional connection terminals 202 (see FIG. 1) each having the portion for fixing to the associated through-hole 201*x*. By virtue of these features, the socket 10A can be made lower than conventional sockets.

No interconnections are provided in the through-holes 91*x* of the substrate 90 and the semiconductor package 60 (connection subject) and the mounting board 70 such as a mother board are connected to each other via only the connection terminals 30 and the bonding portions 41 which are formed at the one ends of the connection terminals 30. Therefore, the connection distance (i.e., the distance of the signal transmission paths) between the semiconductor package 60 (connection subject) and the mounting board 70 such as a mother board can be shortened. This is effective in reducing parasitic inductances, parasitic capacitances, parasitic resistances, etc. and thereby enables the socket 10A to accommodate high-speed signal transmission.

Furthermore, since no interconnections are provided in the through-holes 91*x*, it is not necessary to provide insulating layers for such interconnections. This also contributes to reduction of parasitic capacitances and makes the socket 10A advantageous in terms of high-speed signal transmission.

Embodiment 3

A third embodiment is different from the first embodiment in that the positioning member 50 is not provided over the wiring substrate 20 and the frame portion of the case is given the function of the positioning member 50 and used for positioning the semiconductor package 60. In the third embodiment, components having the same components in the above-described embodiments will not be described in detail.

Figure 12:
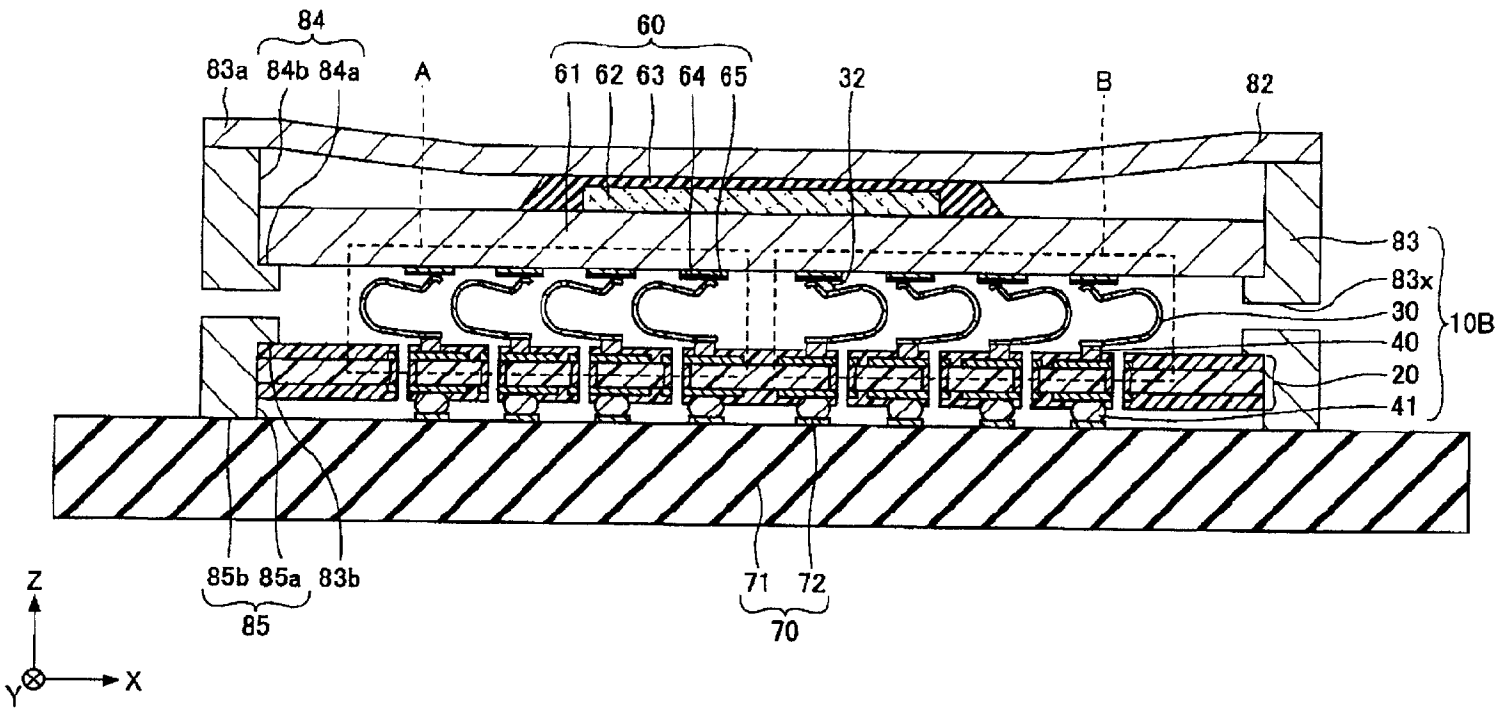
FIG. 12 is a sectional view of a socket according to a third embodiment.

FIG. 12 is a sectional view of a socket 10B according to the third embodiment. As shown in FIG. 12, the socket 10B is different from the socket 10 (see FIGS. 2 and 3) and the socket 10A (see FIGS. 10 and 11) in that the positioning member 50 is not provided over the wiring substrate 20 and a frame portion 83 of a case positions the semiconductor package 60.

Figure 13A:
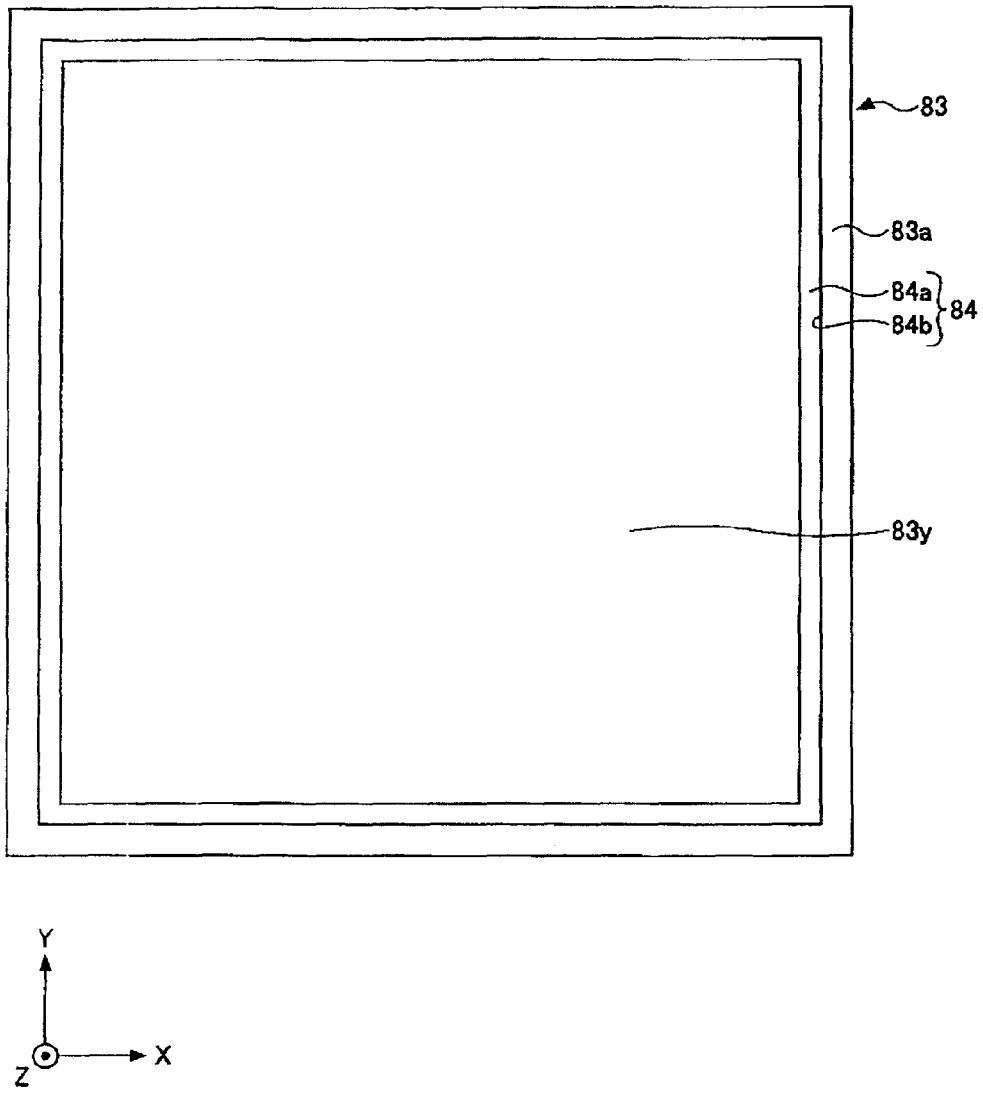
FIG. 13A is a plan view of a frame portion of the socket according to the third embodiment.
Figure 13B:
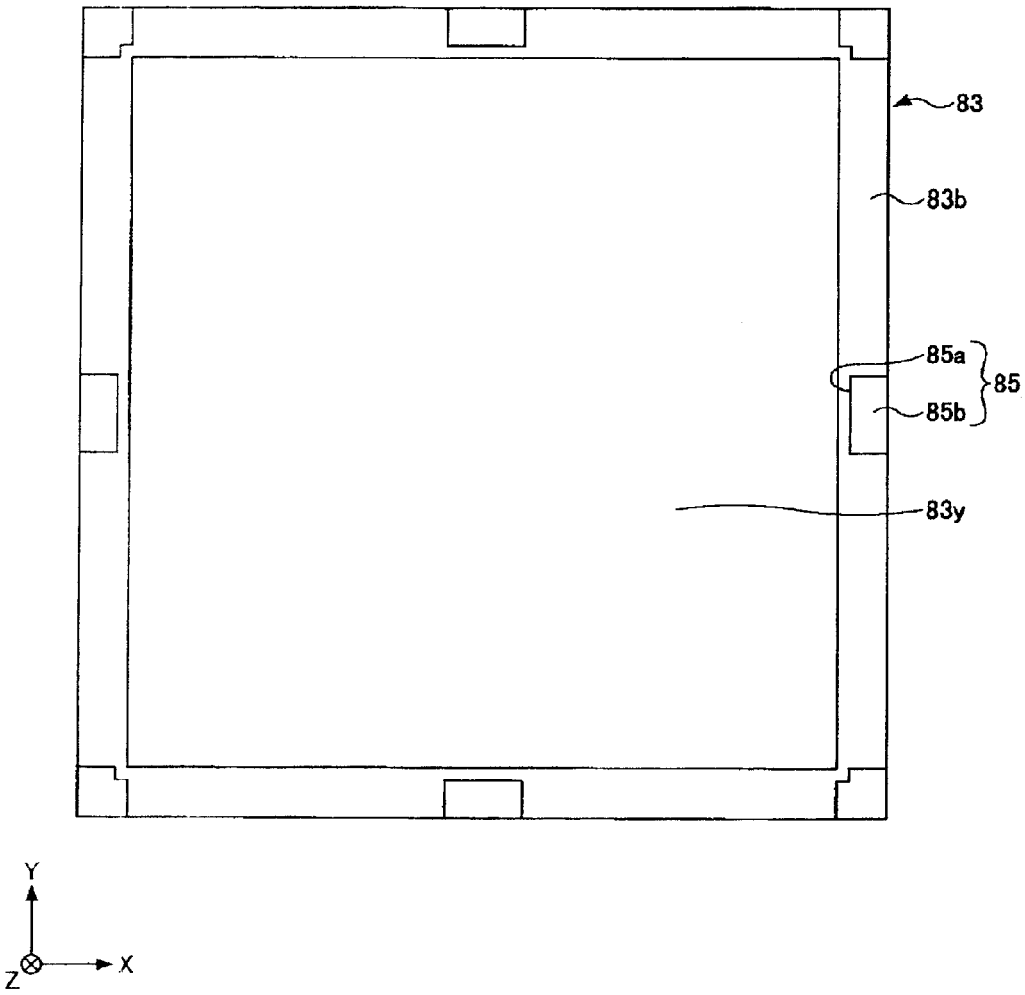
FIG. 13B is a bottom view of the frame portion of the socket according to the third embodiment.
Figure 13C:
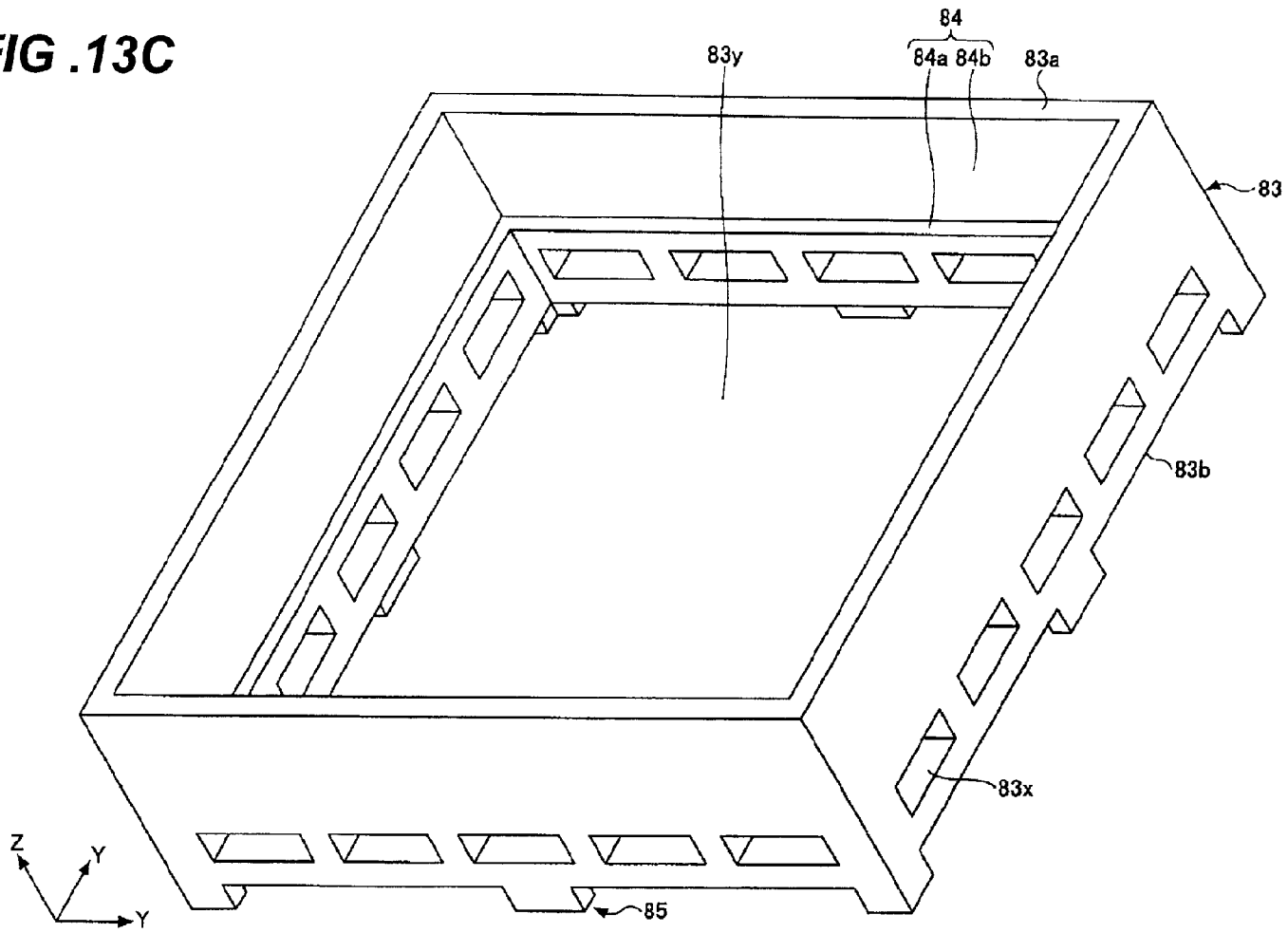
FIG. 13C is a perspective view of the frame portion of the socket according to the third embodiment.

FIGS. 13A, 13B, and 13C are a plan view, a bottom view, and a perspective view, respectively, of the frame portion 83 of the socket 10B according to the third embodiment. As shown in FIGS. 13A-13C, the frame portion 83 is configured in such a manner that a frame-shaped member in which plural holes 83*x* are formed through each of its side walls and a rectangular opening 83*y* is formed at the center is provided with a first positioning portion 84 and second positioning portions 85. The frame portion 83 is made of resin, metal, or the like. The frame portion 83 has functions of positioning and holding each of the semiconductor package 60 and the wiring substrate 20 and registering them with respect to each other. The frame portion 83 also has a function of preventing the interval between the semiconductor package 60 and the wiring substrate 20 from becoming shorter than or equal to a prescribed value. The frame portion 83 is a typical example of a frame-shaped positioning member according to the invention whose side walls are formed with openings.

Since each side wall of the frame portion 83 is formed with the plural holes 83*x*, air flows are formed between the inside and the outside of the frame portion 83. Therefore, the connection terminals 30 are prevented from becoming high in temperature because heat can be dissipated from the connection terminals 30 efficiently, even if heat generated by the semiconductor package 60 as a connection subject is transmitted to the connection terminals 30.

The first positioning portion 84 has a surface 84*a* and surfaces 84*b*. The surface 84*a* is a frame-shaped surface that is located inside a upper surface 83*a* of the frame portion 83 at a lower position than the upper surface 83*a* and that extends approximately parallel with the upper surface 83*a*. The surfaces 84*b* are surfaces that extend approximately perpendicularly to the upper surface 83*a* so as to connect the surface 84*a* to the upper surface 83*a*. The surfaces 84*b* are parts of inner surfaces of the frame portion 83.

The surface 84*a* is in contact with an outer peripheral portion of the lower surface of the semiconductor package 60. The opening that is defined by the surfaces 84*h* has a rectangular shape so as to conform to the plan-view shape of the semiconductor package 60. The opening that is defined by the surfaces 84*b* is slightly larger than the external shape of the wiring substrate 61 to enable insertion and removal of the semiconductor package 60. The surfaces 84*b* may be in contact with the side surfaces (outer circumferential surfaces) of the wiring substrate 61. Or small gaps that do not cause positional deviations between the contact portions 32 of the connection terminals 30 of the socket 10B and the noble metal layers 65 of the semiconductor package 60 may be formed between the surfaces 84*b* and the side surfaces of the wiring substrate 61.

Held by the first positioning portion 84, the semiconductor package 60 does not go to the side of the mounting board 70 past the surface 84*a* of the first positioning portion 84 when the semiconductor package 60 is pressed. This prevents a phenomenon that the semiconductor package 60 excessively goes to the side of the mounting board 70, whereby the connection terminals 30 are deformed too much and damaged.

The second positioning portions 85 are plural projections that project from outer peripheral portions of the lower surface 83*b* of the frame portion 83. Each second positioning portion 85 has an inner side surface 85*a* and a lower surface 85*b*. The wiring substrate 20 of the socket 10B is press-fitted in the second positioning portions 85. The lower surface 83*b* of the frame portion 83 is in contact with an outer peripheral portion of the upper surface of the wiring substrate 20, and the inner side surfaces 85*a* of the second positioning portions 85 are in contact with the side surfaces (outer circumferential surfaces) of the wiring substrate 20.

An imaginary opening that is defined by the inner side surfaces 85*a* and their extensions has a rectangular shape so as to conform to the plan-view shape of the wiring substrate 20, and has approximately the same shape as the external shape of the wiring substrate 20 to enable its press-fitting. The height of each second positioning portion 85 from its lower surface 85*b* to the lower surface 83*b* of the frame portion 83 is approximately the same as the distance between the upper surface of the mounting board 70 and the upper surface of the wiring substrate 20, and the lower surfaces 85*b* of the second positioning portions 85 are in contact with the upper surface of the mounting board 70.

The frame portion 83 is not directly fixed to the mounting board 70. However, since the wiring substrate 20 is fixed to the mounting board 70 via the bonding portions 41, the frame portion 83 in which the wiring substrate 20 is press-fitted is indirectly fixed to the mounting board 70. However, instead of fixing the frame portion 83 to the mounting board 70 indirectly by press-fitting the wiring substrate 20 in the frame portion 83, the frame portion 83 may directly be fixed to the upper surface of the mounting board 70 with bolts or the like that penetrate through the mounting board 70.

As described above, in the socket 10B according to the third embodiment, the plural connection terminals 30 are provided on the wiring substrate 20 in such a manner that each connection terminal 30 is not enclosed by resin or the like and the plural holes 83*x* are formed through each side wall of the frame portion 83 (of the case) for positioning the wiring substrate 20. These features provide the following advantage in addition to the same advantages as the similar features of the first embodiment provide. That is, since the frame portion 83 has the function of the positioning member, the semiconductor package 60 as a connection subject can be positioned although no positioning member is provided over the wiring substrate 20.

Furthermore, the interval between the semiconductor package 60 as a connection subject and the wiring substrate 20 does not become shorter than or equal to a prescribed value. This prevents a phenomenon that the semiconductor package 60 as a connection subject is pressed excessively toward the mounting board 70, whereby the connection terminals 30 are deformed too much and damaged.

Embodiment 4

A fourth embodiment is directed to a socket which has connection terminals on both sides. In the fourth embodiment, components having the same components in the above-described embodiments will not be described in detail.

Figure 14:
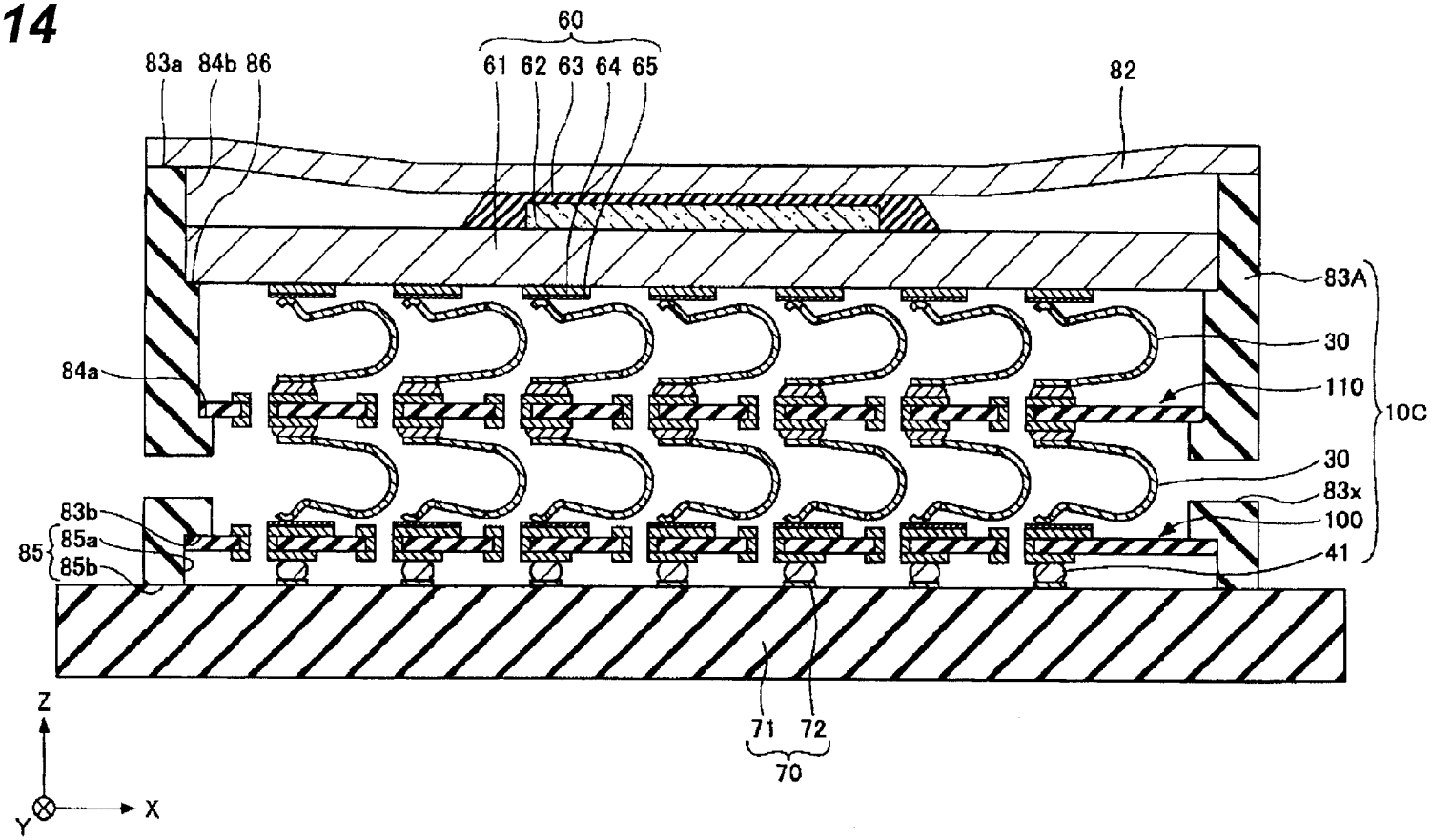
FIG. 14 is a sectional view of a socket according to a fourth embodiment.
Figure 15:
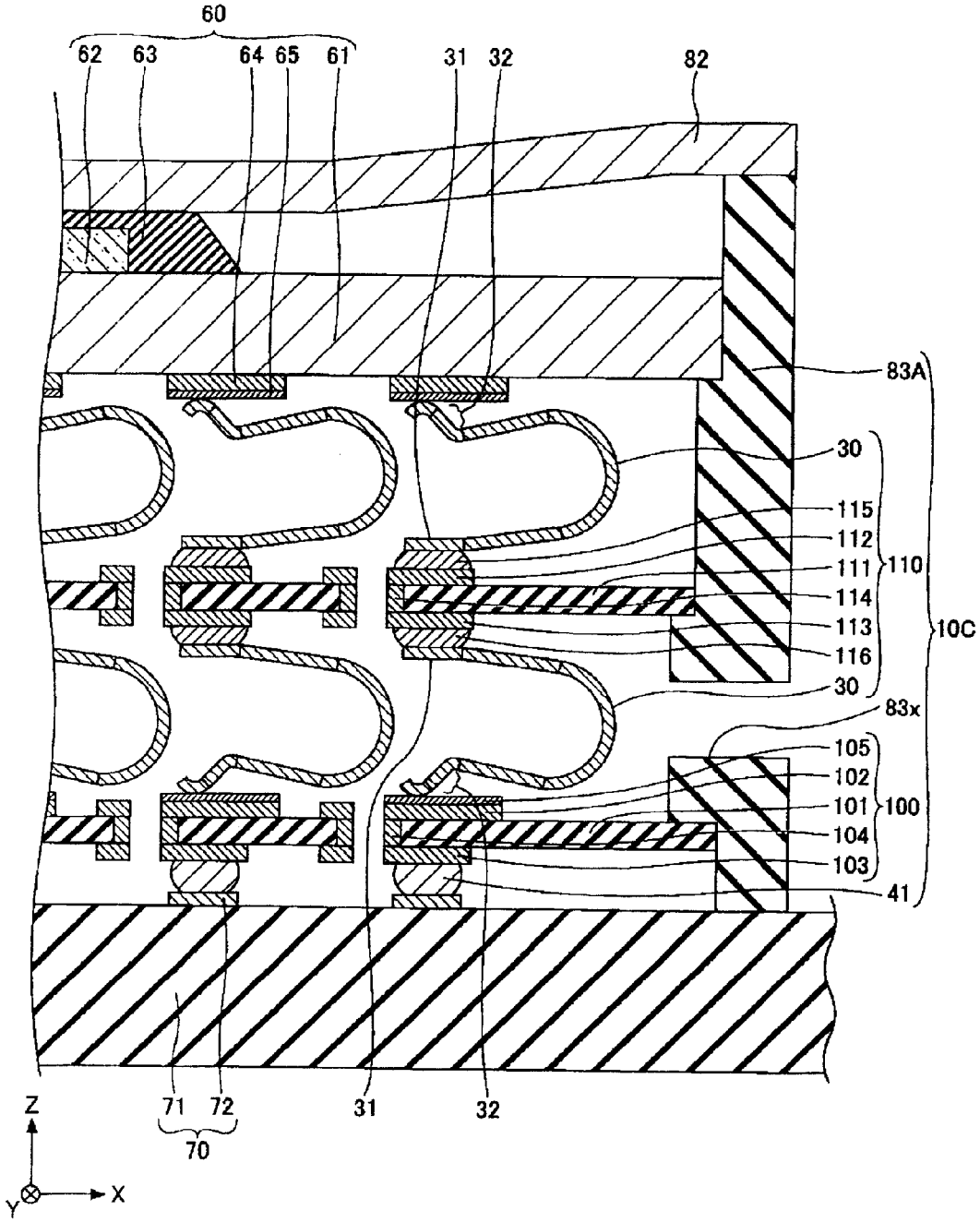
FIG. 15 is an enlarged sectional view of part of FIG. 14.

FIG. 14 is a sectional view of a socket 10C according to the fourth embodiment. FIG. 15 is an enlarged sectional view of part of FIG. 14. As shown in FIGS. 14 and 15, the socket 10C has a frame portion 83A, a first substrate 100, and a second substrate 110 both surfaces of which are provided with connection terminals 30. For the sake of convenience, the connection terminals 30 provided on the side of the semiconductor package 60 are called upper connection terminals 30 and the connection terminals 30 provided on the side of the mounting board 70 are called lower connection terminals 30.

The socket 10C will be described below in detail with reference to FIGS. 14, 15, 16A and 16B.

Figure 16A:
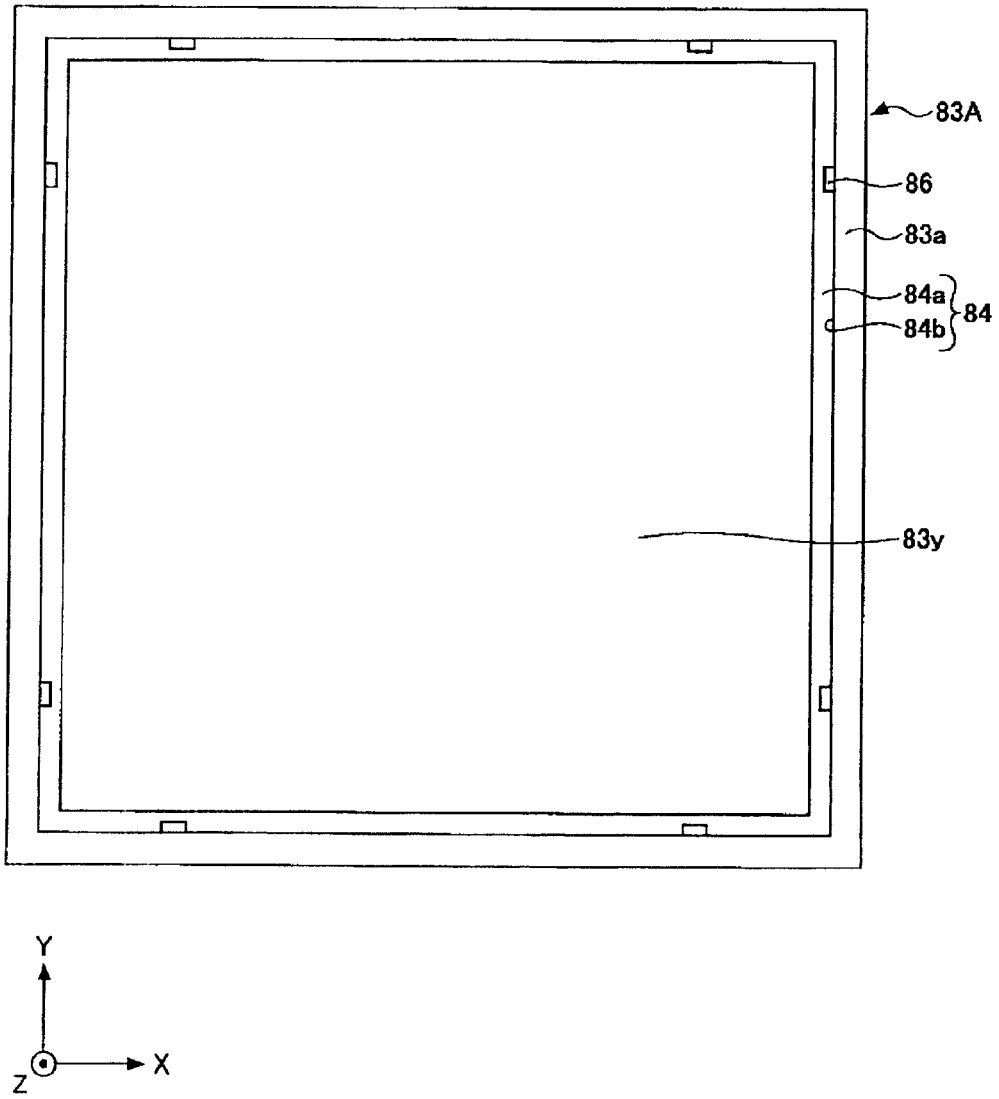
FIG. 16A is a plan view of a frame portion of the socket according to the fourth embodiment.
Figure 16B:
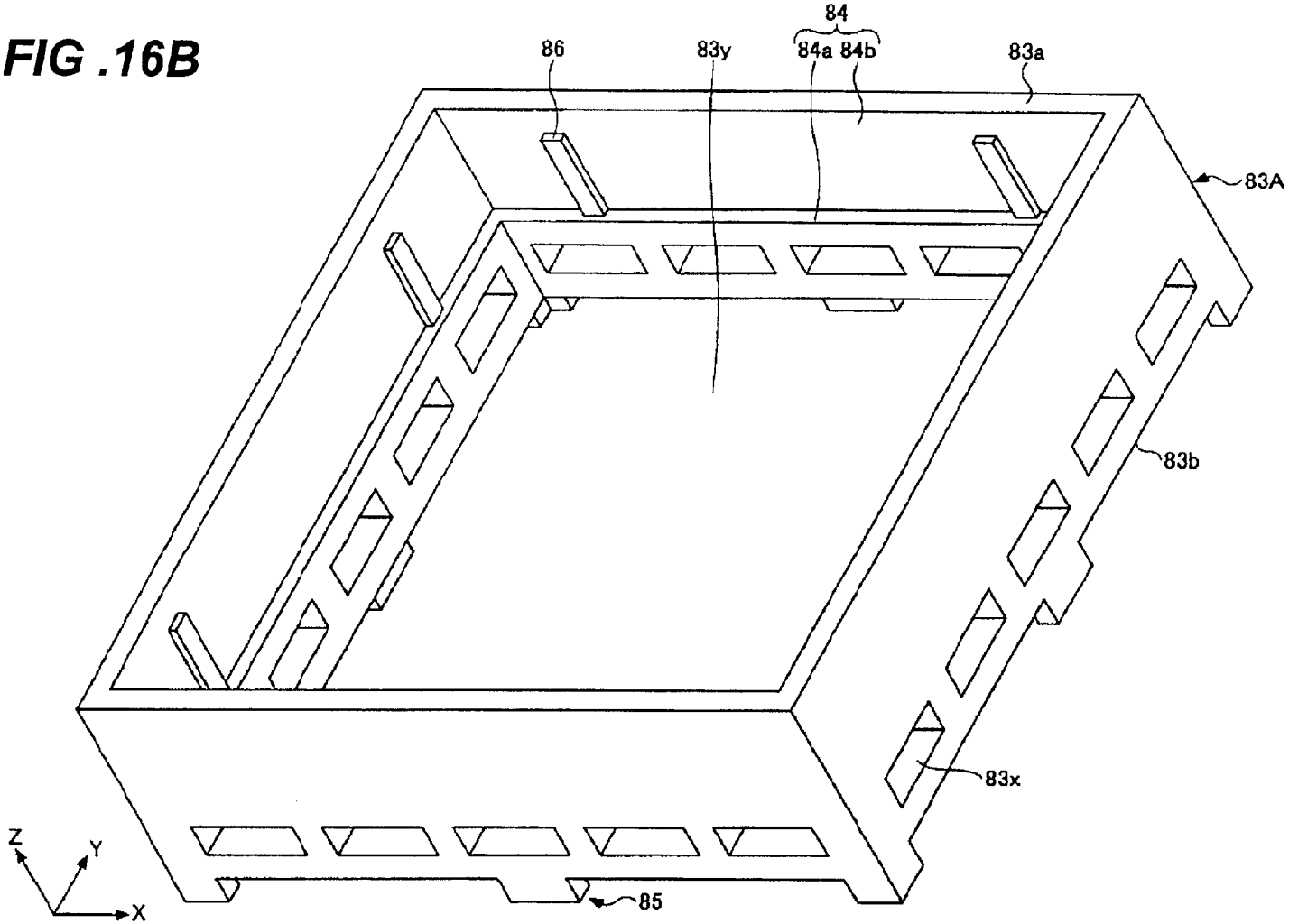
FIG. 16B is a perspective view of the frame portion of the socket according to the fourth embodiment.

FIGS. 16A and 16B are a plan view and a perspective view, respectively, of the frame portion 83A of the socket 10C according to the fourth embodiment. A bottom view of the frame portion 83A is omitted because it is the same as FIG. 13B.

As shown in FIGS. 16A and 16B, the frame portion 83A is different from the frame portion 83 (see FIGS. 13A-13C) in that third positioning portions 86 are added. The frame portion 83A has functions of positioning and holding each of the first substrate 100, the second substrate 110, and the semiconductor package 60 and registering them with respect to each other. The frame portion 83A also has a function of preventing the interval between the first substrate 100 and the second substrate 110 and the interval between the second substrate 110 and the semiconductor package 60 from becoming shorter than or equal to prescribed values. The frame portion 83A is a typical example of a frame-shaped positioning member according to the invention whose side walls are formed with openings.

The third positioning portions 86 are isolated surfaces that are located inside a upper surface 83*a* of the frame portion 83A at a lower position than the upper surface 83*a*. The third positioning portions 86 are in contact with an outer peripheral portion of the lower surface of the wiring substrate 61 of the semiconductor package 60.

The surface 84*a* of the first positioning portion 84 is in contact with an outer peripheral portion of the lower surface of the second substrate 110. The opening that is defined by the surfaces 84*b* has a rectangular shape so as to conform to the plan-view shape of the second substrate 110. The opening that is defined by the surfaces 84*b* is slightly larger than the external shape of the second substrate 110 to enable insertion and removal of the second substrate 110. The surfaces 84*b* may be in contact with the side surfaces (outer circumferential surfaces) of the second substrate 110. Or small gaps that do not cause positional deviations between the contact portions 32 of the upper connection terminals 30 of the socket 10C and the noble metal layers 65 of the semiconductor package 60 may be formed between the surfaces 84*b* and the side surfaces of the second substrate 110.

Held by the first positioning portion 84, the second substrate 110 does not go to the side of the mounting board 70 past the surface 84*a* of the first positioning portion 84 when the second substrate 110 is pressed. This prevents a phenomenon that the second substrate 110 excessively goes to the side of the mounting board 70, whereby the lower connection terminals 30 are deformed too much and damaged.

The first substrate 100 is press-fitted in the second positioning portions 85. The lower surface 83*b* is in contact with an outer peripheral portion of the upper surface of the first substrate 100, and the inner side surfaces 85*a* of the second positioning portions 85 are in contact with the side surfaces (outer circumferential surfaces) of the first substrate 100.

An imaginary opening that is defined by the inner side surfaces 85*a* and their extensions has a rectangular shape so as to conform to the plan-view shape of the first substrate 100, and has approximately the same shape as the external shape of the first substrate 100 to enable its press-fitting. The height of each second positioning portion 85 from its lower surface 85*h* to the lower surface 83*b* of the frame portion 83A is approximately the same as the distance between the upper surface of the mounting board 70 and the upper surface of the first substrate 100, and the lower surfaces 85*b* of the second positioning portions 85 are in contact with the upper surface of the mounting board 70.

The frame portion 83A is not directly fixed to the mounting board 70. However, since the first substrate 100 is fixed to the mounting board 70 via the bonding portions 41, the frame portion 83A in which the first substrate 100 is press-fitted is indirectly fixed to the mounting board 70. However, instead of fixing the frame portion 83A to the mounting board 70 indirectly by press-fitting the first substrate 100 in the frame portion 83A, the frame portion 83A may directly be fixed to the upper surface of the mounting board 70 with bolts or the like that penetrate through the mounting board 70.

In the frame portion 83A, holes 83*x* are formed beside the lower connection terminals 30. Instead, holes 83*x* may be formed beside the upper connection terminals 30. Or additional holes 83*x* may also be formed beside the upper connection terminals 30.

The first substrate 100 has a substrate body 101, conductor layers 102 and 103, via interconnections 104, and noble metal layers 105. The conductor layer 102 and the noble metal layers 105 are formed on one surface of the substrate body 101, and the conductor layer 103 is formed on the other surface of the substrate body 101. The conductor layer 102 and the noble metal layers 105 are wiring layers, and each set of an interconnection of the conductor layer 102 and a noble metal layer 105 constitutes a pad. The conductor layer 103 is a wiring layer and each of its interconnections serves as a pad. The interconnections of the conductor layer 102 are electrically connected to those of the conductor layer 103 by the via interconnections 104, respectively. The via interconnections 104 may be formed by filling in respective through-holes.

For example, the substrate body 101 is formed by impregnating glass fabrics with an insulating resin such as an epoxy resin. For example, the thickness of the substrate body 101 may be about 100 to 200 μm. The conductor layers 102 and 103 and the via interconnections 104 may be made of copper (Cu) or the like. For example, the thickness of each of the conductor layers 102 and 103 may be about 10 to 30 μm. For example, the conductor layers 102 and 103 may be formed by any of various interconnection forming methods such as a semi-additive method or a subtractive method.

The noble metal layers 105 are laid on the upper surfaces of the respective interconnections of the conductor layer 102. The noble metal layers 105 may be layers containing a noble metal such as gold (Au), palladium (Pd), or the like. The noble metal layers 105 may be formed by electroless plating or the like. A nickel (Ni) layer, an Ni/Pd layer (i.e., a metal layer formed by laying an Ni layer and a Pd layer in this order), or the like may be formed as an underlying layer of a gold (Au) layer.

The noble metal layers 105 are provided to increase the reliability of the connection to the lower connection terminals 30. To endure pressure exerted from the lower connection terminals 30 which are high in springness, the noble metal layers 105 are much thicker than ordinary gold plating layers etc. The thickness of gold plating layers etc. that are usually provided to increase the reliability of the connection to solder balls etc. are about 0.05 μm or less. In contrast, for example, the thickness of the noble metal layers 105 is about 0.4 μm, that is, eight times or more as great as that of ordinary gold plating layers etc.

The interconnections of the conductor layer 103 of the first substrate 100 are connected to the conductor layers 72 of the mounting board 70 via the bonding portions 41, respectively.

The second substrate 110 has a substrate body 111, conductor layers 112 and 113, via interconnections 114, bonding portions 115, bonding portions 116, and upper and lower connection terminals 30 which are high in springness. The conductor layers 112 and 113 are wiring layers, and each interconnection of the conductor layers 112 and 113 serves as a pad. The conductor layer 112 is formed on one surface of the substrate body 111, and the conductor layer 113 is formed on the other surface of the substrate body 111. The interconnections of the conductor layer 112 are electrically connected to those of the conductor layer 113 by the via interconnections 114, respectively, which penetrate through the substrate body 111 between its two surfaces. The via interconnections 114 may be formed by filling in the respective through-holes. The upper connection terminals 30 are fixed to the conductor layer 112 via the respective bonding portions 115. Likewise, the lower connection terminals 30 are fixed to the conductor layer 113 via the respective bonding portions 116.

For example, the substrate body 111 is formed by impregnating glass fabrics with an insulating resin such as an epoxy resin. For example, the thickness of the substrate body 111 may be about 100 to 200 μm. The conductor layers 112 and 113 and the via interconnections 114 may be made of copper (Cu) or the like. For example, the thickness of each of the conductor layers 112 and 113 may be about 10 to 30 μm. For example, the conductor layers 112 and 113 may be formed by any of various interconnection forming methods such as a semi-additive method or a subtractive method.

The bonding portions 115 and 116 are made of solder. For example, as the solder, alloy containing Pb, alloy of Sn and Cu, alloy of Sn and Ag, and alloy of Sn, Ag, and Cu may be used. Another example material of the bonding portions 115 and 116 is a conductive resin paste (e.g., Ag paste).

To hold the outer peripheral portion of the lower surface of the second substrate 110 by the surface 84*a* of the first positioning portion 84, the outer peripheral portion of the second substrate 110 may be formed with cuts at positions corresponding to the respective third positioning portions 86.

The fixed portion 31 of each of the upper and lower connection terminals 30 is fixed to the associated interconnection of the conductor layer 112 or 113 via the associated bonding portion 115 or 116 and thereby connected to the associated interconnection of the conductor layer 112 or 113 electrically and mechanically. To increase the reliability of the connection to the bonding portions 115 and 116, gold plating layers or the like may be formed on the interconnections of the conductor layers 112 and 113. However, the thickness of the gold plating layers or the like may be about 0.05 μm or less because they need not endure pressure exerted from the connection terminals 30 which are high in springness.

The contact portions 32 of the upper connection terminals 30 are in contact with (i.e., electrically connected to) the respective noble metal layers 65 of the semiconductor package 60 in such a manner as to be separated from the latter. The contact portions 32 of the lower connection terminals 30 are in contact with (i.e., electrically connected to) the respective noble metal layers 105 of the first substrate 100 in such a manner as to be separated from the latter. That is, the frame portion 83A positions and holds the first substrate 100, the second substrate 110, and the semiconductor package 60 so that the contact portions 32 of the upper connection terminals 30 are located at such positions as to face the respective noble metal layers 65 of the semiconductor package 60 and that the contact portions 32 of the lower connection terminals 30 are located at such positions as to face the respective noble metal layers 105 of the first substrate 100.

Sufficiently high reliability of connection could not be attained if the first substrate 100 were omitted and the lower connection terminals 30 which are high in springness were in direct contact with the conductor layers 72 (whose surfaces are not formed with noble metal layers) of the mounting board 70 such as a mother board. In contrast, in the embodiment, high reliability of connection can be attained because the first substrate 100 is connected to the mounting board 70 such as a mother board via the bonding portions 41 and the lower connection terminals 30 are in contact with the respective noble metal layer 105 of the first substrate 100.

As described above, in the socket 10C according to the fourth embodiment, the plural connection terminals 30 are provided on both surfaces of the substrate body 111 of the second substrate 110 in such a manner that each connection terminal 30 is not enclosed by resin or the like and the plural holes 83*x* are formed through each side wall of the frame portion 83A for positioning the second substrate 110. These features provide the same advantages as the similar features of the first embodiment.

Since the frame portion 83A has the function of the positioning member, the semiconductor package 60 as a connection subject can be positioned although no positioning member is provided over the first substrate 100 and the second substrate 110.

The interval between the semiconductor package 60 as a connection subject and the second substrate 110 and the interval between the second substrate 110 and the first substrate 100 do not become shorter than or equal to a prescribed value. This prevents a phenomenon that the semiconductor package 60 as a connection subject or the second substrate 110 is pressed excessively toward the mounting board 70, whereby the upper or lower connection terminals 30 are deformed too much and damaged.

The upper connection terminals 30 of the second substrate 110 are not fixed to the semiconductor package 60 with solder or the like and hence can be separated from the latter, and the lower connection terminals 30 of the second substrate 110 are not fixed to the first substrate 100 with solder or the like and hence can be separated from the latter. Since the second substrate 110 is detachable, it can easily be replaced by a good one even if a connection terminal(s) 30 is damaged.

High reliability of connection can be attained because the first substrate 100 is connected to the mounting board 70 such as a mother board and the lower connection terminals 30 of the second substrate 110 are in contact with the respective noble metal layers 105 of the first substrate 100. (Sufficiently high reliability of connection could not be attained if the first substrate 100 were omitted and the lower connection terminals 30 of the second substrate 110 were in direct contact with the respective conductor layers 72 (pads; whose surfaces are not formed with noble metal layers) of the mounting board 70 such as a mother board.

Embodiment 5

A fifth embodiment is directed to a socket which has positioning members having a different shape than in the first to fourth embodiments. In the fifth embodiment, components having the same components in the above-described embodiments will not be described in detail.

Figure 17:
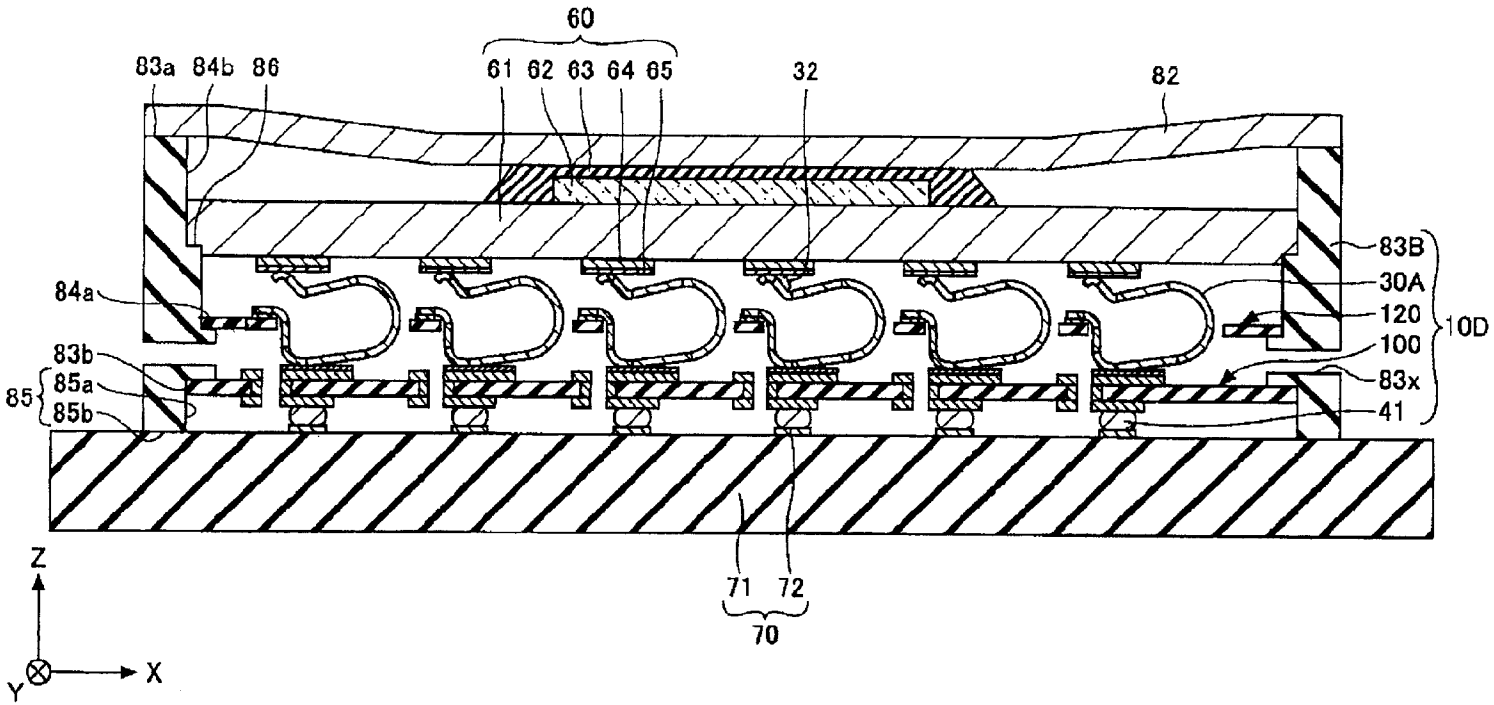
FIG. 17 is a sectional view of a socket according to a fifth embodiment.
Figure 18:
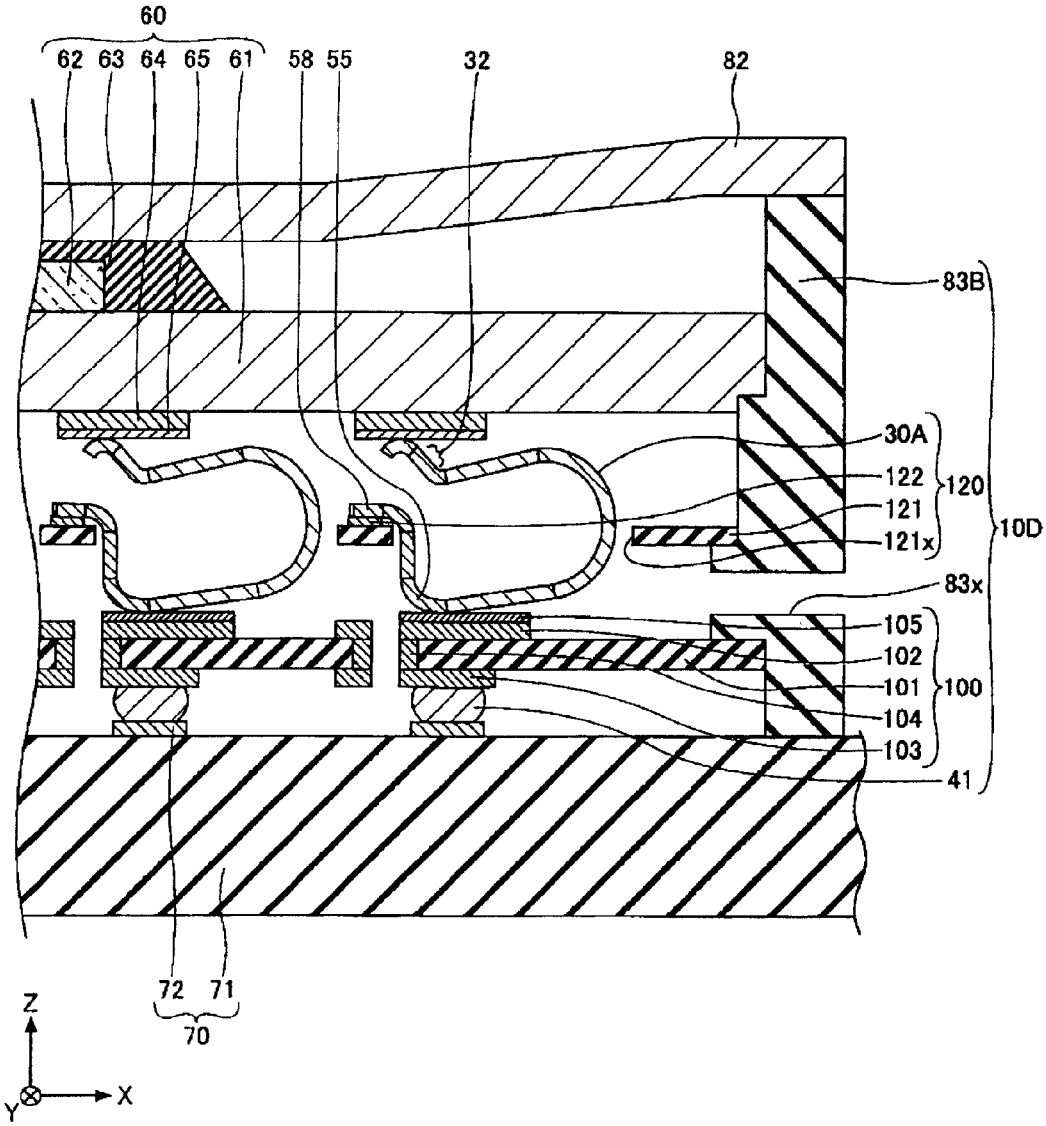
FIG. 18 is an enlarged sectional view of part of FIG. 17.

FIG. 17 is a sectional view of a socket 10D according to the fifth embodiment. FIG. 18 is an enlarged sectional view of part of FIG. 17. As shown in FIGS. 17 and 18, the socket 10D has a frame portion 83B, a first substrate 100, and a second substrate 120 which is provided with connection terminals 30A. Portions of the frame portion 83B are given the same reference symbols as the corresponding portions of the frame portion 83A because the frame portion 83B has approximately the same structure as the frame portion 83A and with differences found only in the height, the size of the holes 83*x*, etc.

The frame portion 83B has functions of positioning and holding each of the first substrate 100, the second substrate 120, and the semiconductor package 60 and registering them with respect to each other. The frame portion 83B also has a function of preventing the interval between the first substrate 100 and the second substrate 120 and the interval between the second substrate 120 and the semiconductor package 60 from becoming shorter than or equal to prescribed values. The frame portion 83B is a typical example of a frame-shaped positioning member according to the invention whose side walls are formed with openings.

The third positioning portions 86 are the same as those used in the fourth embodiment. The surface 84*a* of the first positioning portion 84 is in contact with an outer peripheral portion of the lower surface of the second substrate 120. The opening that is defined by the surfaces 84*b* has a rectangular shape so as to conform to the plan-view shape of the second substrate 120. The opening that is defined by the surfaces 84*b* is slightly larger than the external shape of the second substrate 120 to enable insertion and removal of the second substrate 120. The surfaces 84*b* may be in contact with the side surfaces (outer circumferential surfaces) of the second substrate 120. Or small gaps that do not cause positional deviations between the second substrate 120 and the semiconductor package 60 of between the second substrate 120 and the first substrate 100 may be formed between the surfaces 84*b* and the side surfaces of the second substrate 120. The plural second positioning portions 85 and the first substrate 100 are the same as in the fourth embodiment.

In the frame portion 83B, the holes 83*x* are formed on the first substrate 100 side of the second substrate 120. Instead, the holes 83*x* may be formed on the semiconductor package 60 side of the second substrate 120. Or additional holes 83*x* may also be formed on the semiconductor package 60 side of the second substrate 120.

The second substrate 120 has a substrate body 121 which is formed with through-holes 121*x*, an adhesive layer 122, and connection terminals 30A which are high in springness. The connection terminals 30A are inserted in the respective through-holes 121*x*, and their bonding portions 58 are bonded to the surface, opposed to the semiconductor package 60, of the second substrate 120 by the adhesive layer 122. In each connection terminal 30A, a contact portion 32 is located over the surface, opposed to the semiconductor package 60, of the second substrate 120 and a second contact portion 55 is located under the surface, not opposed to the semiconductor package 60, of the second substrate 120. The shape of each through-hole 121*x* may be determined as appropriate so as to conform to the shape of each connection terminal 30A, and each through-hole 121*x* may have a rectangular plan-view shape.

The substrate body 121 is a base member to which the connection terminals 30A are bonded. For example, the substrate body 121 may be a rigid substrate (e.g., FR4 substrate) formed by impregnating glass fabrics with an insulating resin such as an epoxy resin. Alternatively, the substrate body 121 may be a flexible film-like substrate made of an insulating resin such as a polyimide resin. For example, the thickness of the substrate body 121 may be about 50 to 100 μm.

In the embodiment, no wiring patterns are formed on the substrate body 121. However, if necessary, wiring patterns may be formed on the substrate body 121. For example, where adjoining connection terminals 30A serve to transmit the same signal such as a power voltage or a reference voltage (GND voltage), they may be connected to each other by a wiring patter formed on the substrate body 121 to stabilize the power voltage, the reference voltage, or the like.

The adhesive layer 122 is to bond the connection terminals 30A to the substrate body 121. It is preferable that the adhesive layer 122 be made of a thermosetting adhesive. This is to prevent melt of the adhesive layer 122 even if its temperature is made high due to heat generation of the semiconductor package 60, an ambient temperature of the socket 10D, or the like. The combination of the substrate body 121 may be a flexible film-like substrate in which a thermosetting adhesive layer is formed on a surface of an insulating resin substrate made of a polyimide resin or the like.

An alternative structure is possible in which another substrate which is the same as the second substrate 120 is prepared, adhesive is applied to both surfaces of the bonding portion 58 of each connection terminal 30A, and the connection terminals 30A are fixed being sandwiched between the two second substrates 120 via the adhesive layers. This structure can increase the strength of adherence of the connection terminals 30A to the second substrates 120.

Each connection terminal 30A is a conductive connection terminal that is high in springness and is made of phosphor bronze, beryllium copper, a Cu-based alloy, or the like.

The contact portion 32 of each connection terminal 30A is in contact with the associated noble metal layer 65 of the semiconductor package 60 in such a manner that it can be separated from the noble metal layer 65, and is thereby connected to the noble metal layer 65 electrically. The second contact portion 55 of each connection terminal 30A is in contact with the associated noble metal layer 105 of the first substrate 100, and it thereby connected to the noble metal layer 105 electrically. That is, the frame portion 83B positions and holds the first substrate 100, the second substrate 120, and the semiconductor package 60 so that the contact portions 32 of the connection terminals 30A are located at such positions as to face the respective noble metal layers 65 of the semiconductor package 60 and that the second contact portions 55 of the connection terminals 30A are located at such positions as to face the respective noble metal layers 105 of the first substrate 100.

Figure 19A:
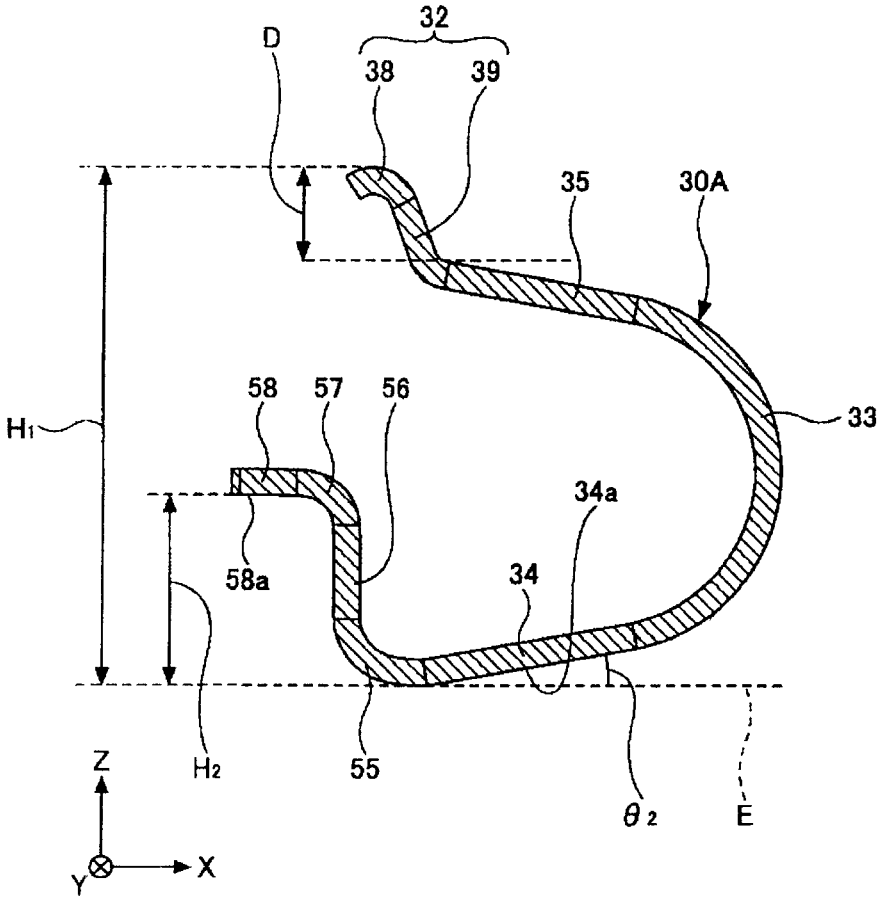
FIG. 19A is a sectional view of each connection terminal in the fifth embodiment.
Figure 19B:
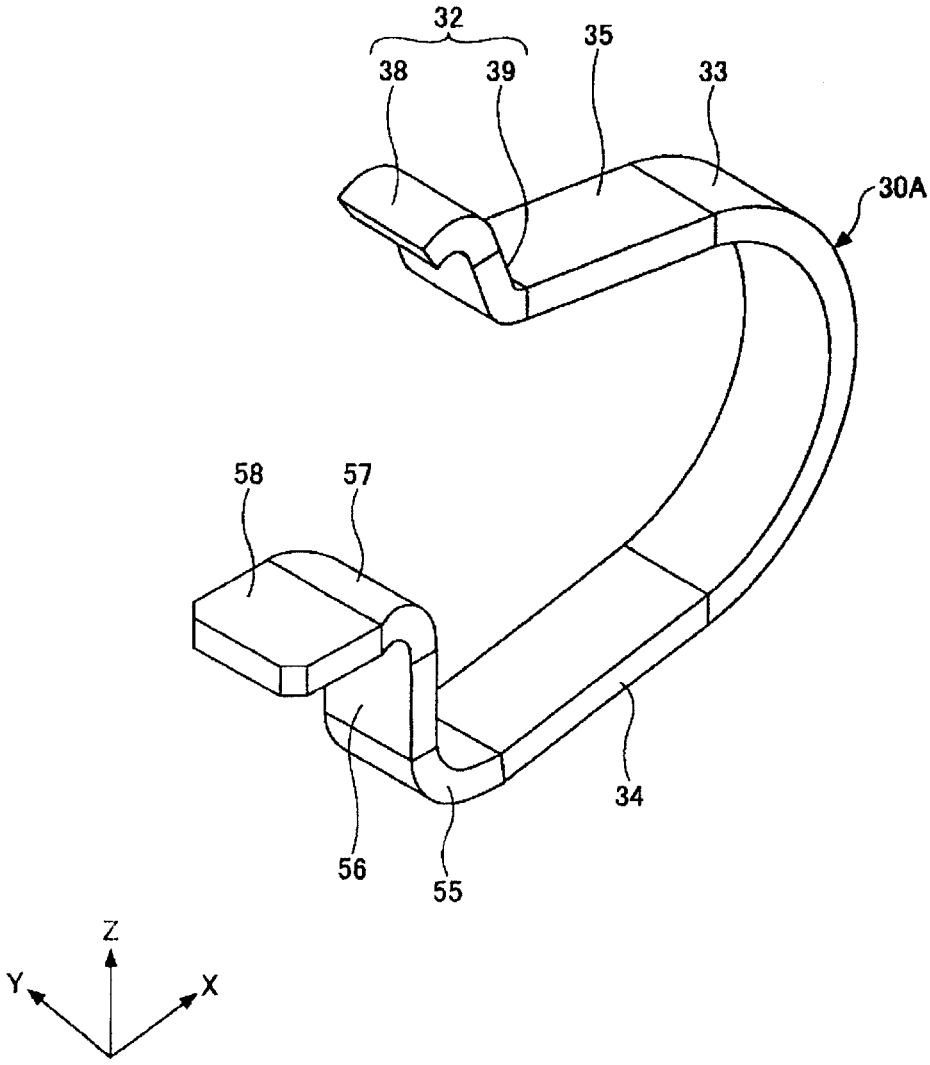
FIG. 19B is a perspective view of each connection terminal in the fifth embodiment.

A detailed structure of each connection terminal 30A will now be described with reference to FIGS. 19A and 19B. FIGS. 19A and 19B are a sectional view and a perspective view, respectively, of each connection terminal 30A used in the fifth embodiment. As shown in FIGS. 19A and 19B, each connection terminal 30A is different from each connection terminal 30 shown in FIGS. 6A and 6B in having the second contact portion 55, a third support portion 56, a bent portion 57, and the bonding portion 58 in place of the fixed portion 31 of each connection terminal 30. The portions that are different than in each connection terminal 30 shown in FIGS. 6A and 6B will be described below.

The second contact portion 55 has a round sectional shape. The thickness of the second contact portion 55 may be 0.08 mm, for example. The second contact portion 55 is a portion to contact the associated noble metal layer 105 of the first substrate 100. To lower the contact resistance, it is preferable that the surface, to contact the associated noble metal layer 105, of the second contact portion 55 be formed with an Au plating film (thickness: 0.3 to 0.5 μm, for example) or the like.

The first support portion 34 exists between the spring portion 33 and the second contact portion 55. One end portion of the first support portion 34 is integral with the spring portion 33, and the other end portion of the first support portion 34 is integral with the second contact portion 55. The first support portion 34 is shaped like a flat plate.

The first support portion 34 is formed in such a manner that the angle $\theta_2$ formed by a plane E which is parallel with a surface 58*a*, opposed to the first substrate 100 and being parallel with the XY plane, of the bonding portion 58 and a surface 34*a*, opposed to the first substrate 100, of the first support portion 34 becomes an acute angle $\theta_2$, which may be set at 5° to 15°, for example.

The third support portion 56 serves to support the bent portion 57 and the bonding portion 58. One end portion of the third support portion 56 is integral with the second contact portion 55 and the other end portion of the third support portion 56 is integral with the bent portion 57. The third support portion 56 is shaped like a flat plate and extends from the second contact portion 55 toward the contact portion 32 (i.e., away from the second contact portion 55). For example, the width and the thickness of the third support portion 56 may be the same as those of the contact portion 32.

The bent portion 57, which has a round shape, is provided so that the third support portion 56 and the bonding portion 58 form a prescribed angle. One end portion of the bent portion 57 is integral with the third support portion 56 and the other end portion of the bent portion 57 is integral with the bonding portion 58. For example, the width and the thickness of the bent portion 57 may be the same as those of the contact portion 32.

The bonding portion 58 is to bond the connection terminal 30A to the second substrate 120. The bonding portion 58 is shaped like a flat plate, and its one end is integral with the bent portion 57. The surface 58*a* of the bonding portion 58 is bonded to one surface of the second substrate 120. For example, the thickness of the bonding portion 58 may be the same as that of the contact portion 32. To increase the strength of adherence to the second substrate 120, it is preferable that the width of the bonding portion 58 be greater than that of the other portions.

The connection terminals 30A may be manufactured by the same method as the connection terminals 30. For example, the height $H_1$ of each connection terminal 30A in the state of FIG. 19A (i.e., the state that the contact portion 32 of the connection terminal 30A is not pressed) may be set at about 1.5 mm. For example, the height $H_2$ of each connection terminal 30A (from the plane E to the surface 58*a* of the bonding portion 58) may be set at about 0.6 mm. For example, the compression range of the connection terminal 30A may be set at about 0.4 mm.

As described above, in the socket 10D according to the fifth embodiment, the second substrate 120 is provided with the plural connection terminals 30A in such a manner that each connection terminal 30A is not enclosed by resin or the like and the plural holes 83*x* are formed through each side wall of the frame portion 83B for positioning the second substrate 120. These features provide the same advantages as the similar features of the first embodiment.

Since the frame portion 83B has the function of the positioning member, the semiconductor package 60 as a connection subject can be positioned although no positioning member is provided over the first substrate 100.

The interval between the semiconductor package 60 as a connection subject and the second substrate 120 and the interval between the second substrate 120 and the first substrate 100 do not become shorter than or equal to prescribed values. This prevents a phenomenon that the semiconductor package 60 as a connection subject or the second substrate 120 is pressed excessively toward the mounting board 70, whereby the connection terminals 30A are deformed too much and damaged.

The connection terminals 30A of the second substrate 120 are not fixed to the semiconductor package 60 or the first substrate 100 with solder or the like and hence can be separated from the latter. Since the second substrate 120 is detachable, it can easily be replaced by a good one even if a connection terminal(s) 30A is damaged.

High reliability of connection can be attained because the first substrate 100 is connected to the mounting board 70 such as a mother board and the second contact portions 55 of the connection terminals 30A are in contact with the respective noble metal layers 105 of the first substrate 100. (Sufficiently high reliability of connection could not be attained if the first substrate 100 were omitted and the second contact portions 55 of the connection terminals 30A were in direct contact with the respective conductor layers 72 (pads: whose surfaces are not formed with noble metal layers) of the mounting board 70 such as a mother board.

Furthermore, as in the fourth embodiment in which both surfaces of the second substrate 110 is provided with the connection terminals 30, each connection terminal 30A is inserted in the associated through-hole 121*x* so as to extend over and under the respective surfaces of the second substrate 120 and is fixed to the second substrate 120. This structure makes it possible to shorten the vertical distance between the two ends of each connection terminal 30A than that of each connection terminal 30 of the socket 10C according to the fourth embodiment. As a result, the connection distance (i.e., the distance of the signal transmission paths) between the semiconductor package 60 (connection subject) and the mounting board 70 such as a mother board can be shortened, and the electrical characteristics can thereby be improved. This structure also makes it possible to shorten the height of the socket 10D.

Embodiment 6

Figure 20A:
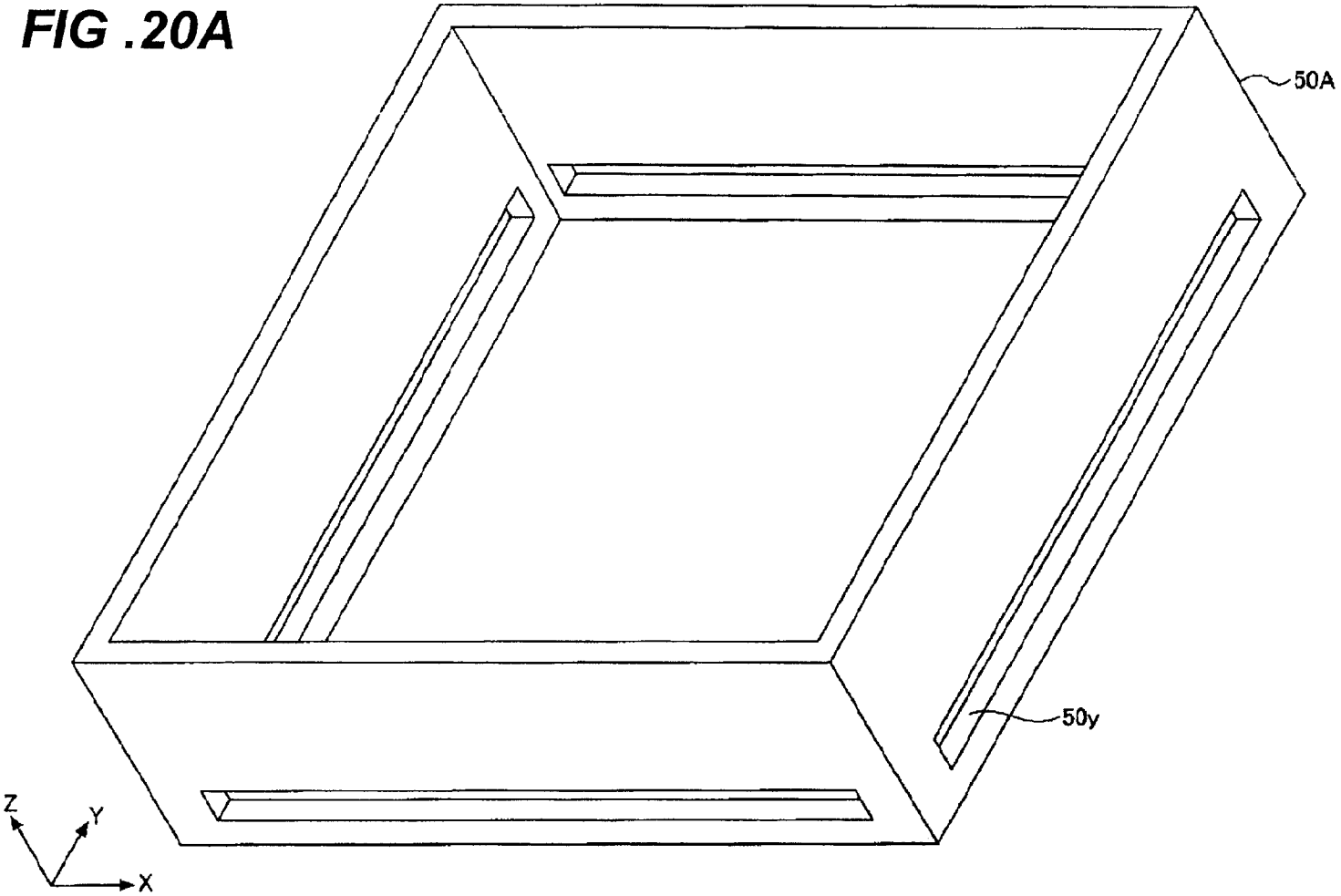
FIG. 20A is a perspective view of a modified positioning member.

A sixth embodiment is directed to modified positioning members. FIG. 20A is a perspective view of a modified positioning member. As shown in FIG. 20A, a positioning member 50A is different from the positioning member 50 (see FIG. 5) in that the holes 50*x* are replaced by holes 50*y*. The holes 50*y* are long in the X direction or the Y direction, and one hole 50*y* is formed in each side wall of the positioning member 50A. As exemplified by this modification, the number and the shape of holes formed in the positioning member are not limited to a particular number or shape and may be determined as appropriate. For example, holes that having a circular, elliptical, or like plan-view shape may be formed in place of the holes 50*x* or 50*y* having a rectangular plan-view shape. Every side wall of the positioning member need not necessarily be formed with a hole(s), and arbitrary side walls may be formed with a hole(s) taking air flows into consideration.

Figure 20B:
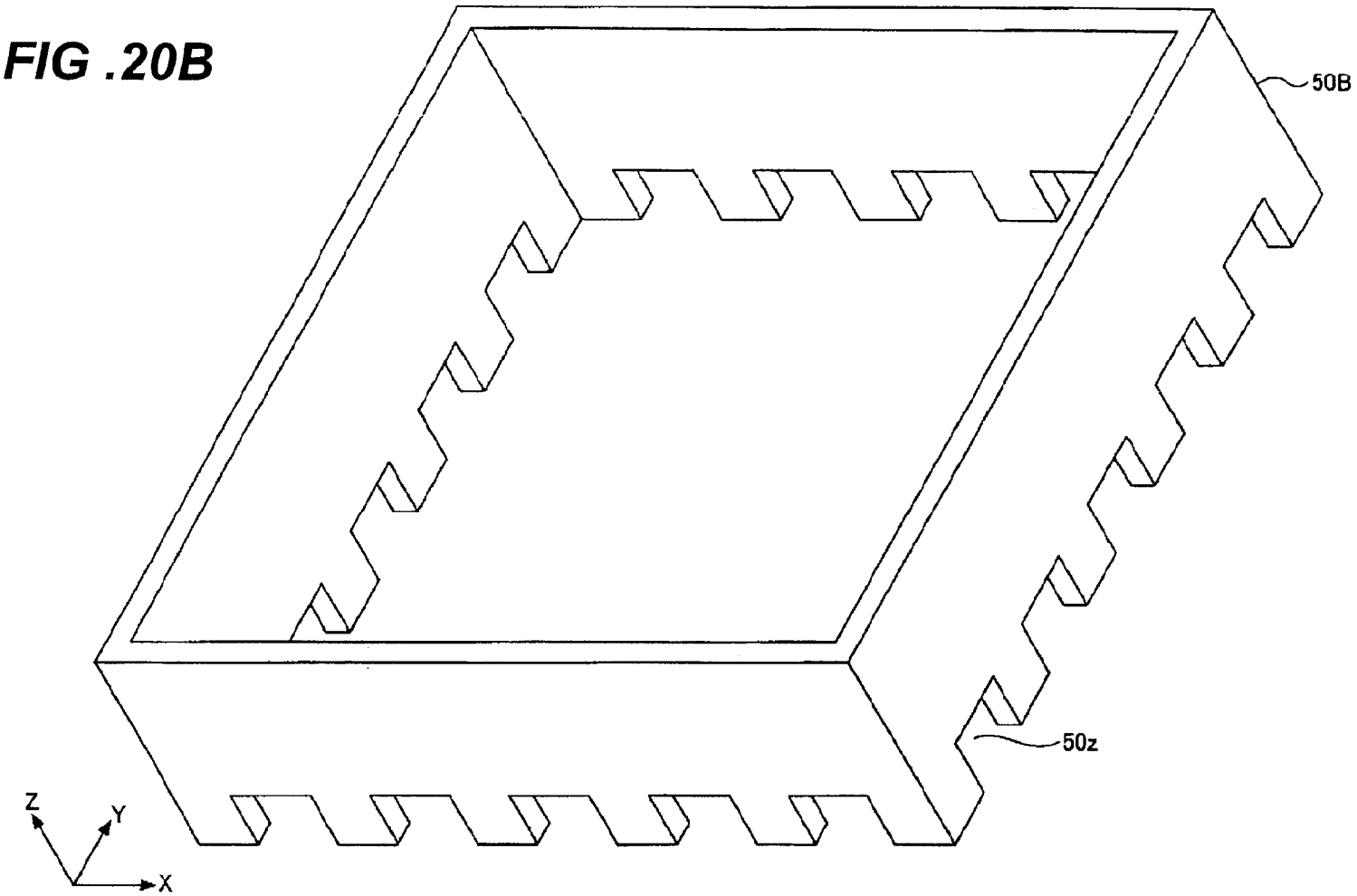
FIG. 20B is a perspective view of another modified positioning member.

FIG. 20B is a perspective view of another modified positioning member. As shown in FIG. 20B, a positioning member 50B is different from the positioning member 50 (see FIG. 5) in that the holes 50*x* are replaced by cuts 50*z*. The lower surfaces of the side walls of the positioning member 50B are formed with plural cuts 50*z*.

As in this modification, to form air flows between the inside and the outside of the positioning member, the side walls of the positioning member may be formed with cuts rather than holes. As in the case where the positioning member is formed with holes, the number and the shape of cuts formed in the positioning member are not limited to a particular number or shape and may be determined as appropriate. For example, cuts that having a semicircular or like plan-view shape may be formed in place of the cuts 50*z* having a rectangular plan-view shape. Every side wall of the positioning member need not necessarily be formed with cuts, and arbitrary side walls may be formed with cuts taking air flows into consideration. The upper surface of the side walls of the positioning member may be formed with cuts instead of or in addition to the lower surface of the side walls. The holes and cuts formed in the side walls of the positioning member may generically be called openings.

The sixth embodiment is directed to the modifications of the positioning member 50. The frame portions 83 etc. may be modified in the same manners as in the sixth embodiment when they are given the function of the positioning member.

Although the preferred embodiments have been described above, the invention is not limited to the above-described embodiments. Part of each embodiment may be modified or replaced by other elements in various manners without departing from the spirit and scope of the invention as claimed.

For example, although in each embodiment the socket is used for the mounting board such as a mother board, the socket according to each embodiment may also be used for, for example, a board for a semiconductor package test. If the socket 10 according to the first embodiment is used for a board for a semiconductor package test, a test of electrical characteristics etc. of a semiconductor package can be performed repeatedly.

Although each embodiment uses the connection terminals having a curved portion, in the invention the shape of the connection terminals is not limited to a particular one because the object of the invention is to increase the heat dissipation of connection terminals by forming air flows. That is, the invention can also be applied to connection terminals not having a curved portion.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A socket comprising:

a wiring substrate comprising a first surface and a second surface opposite to the first surface;

a plurality of connection terminals provided on the wiring substrate and each formed of a conductive elastic member and comprising a contact portion, a curved portion connected to the contact portion, and a fixed portion connected to the curved portion and fixed onto the wiring substrate, wherein the connection terminals extend from the first surface of the wiring substrate; and a positioning member formed in a frame shape and provided on the wiring substrate to surround the connection terminals, the positioning member comprising a sidewall plate having an upper side edge portion and a lower side edge portion opposite to the upper side edge portion, wherein a hole is formed through the sidewall plate and separated from the upper side edge portion and the lower side edge portion, wherein the wiring substrate comprises a plurality of through holes formed therethrough, and each of the plurality of connection terminals passes through a corresponding one of the through holes, wherein the respective fixed portions are fixed onto the second surface of the wiring substrate, and the respective contact portions extend from the first surface of the wiring substrate.

2. The socket according to claim 1, wherein a bottom surface of the sidewall plate of the positioning member is fixed onto the first surface of the wiring substrate.

3. The socket according to claim 1, wherein an inner side surface of the sidewall plate of the positioning member contacts the wiring substrate.

4. The socket according to claim 1, wherein a plurality of holes are formed through the sidewall plate and separated from the upper side edge portion and the lower side edge portion, the plurality of holes are arranged in line so as to surround the connection terminals.

5. The socket according to claim 4, wherein the plurality of holes face the connection terminals, when viewed from a surface direction of the wiring substrate.

6. A semiconductor device comprising:

a mounting substrate;

a socket mounted on the mounting substrate; and a semiconductor package housed in the socket and comprising a plurality of pads thereon, wherein the socket comprises:

a wiring substrate comprising a first surface and a second surface opposite to the first surface, wherein the first surface faces the semiconductor package;

a plurality of connection terminals provided on the wiring substrate and each comprising a contact portion, wherein the respective connection terminals extend from the first surface of the wiring substrate to contact a corresponding one of the pads on the semiconductor package; and a positioning member formed in a frame shape and provided on the wiring substrate to surround the connection terminals, the positing member comprising a sidewall plate having a plurality of holes formed therethrough, wherein the semiconductor package is positioned by the positioning member such that the respective connection terminals face the corresponding pad on the semiconductor package, and wherein a bottom surface of the sidewall plate of the positioning member is fixed onto the first surface of the wiring substrate.

7. The semiconductor device according to claim 6, wherein the wiring substrate is connected electrically to the mounting board via bonding portions.

8. The semiconductor device according to claim 6, further comprising:

a lid provided on the semiconductor package so as to press the semiconductor package to the socket, so that the respective contact portions of the connection terminals contacts the corresponding pad on the semiconductor package.

9. The semiconductor device according to claim 6, wherein the sidewall plate of the positioning member has an upper side edge portion and a lower side edge portion opposite to the upper side edge portion, and each of the plurality of holes is separated from the upper side edge portion and the lower side edge portion.

10. The semiconductor device according to claim 6, wherein the wiring substrate and the mounting substrate are made of the same material.

11. The semiconductor device according to claim 6, wherein an inner surface of the sidewall plate of the positioning member contacts a side surface of the semiconductor package so as to position the semiconductor package relative to the wiring substrate of the socket.

12. The semiconductor device according to claim 6, wherein the plurality of connection terminals are each formed of a conductive elastic member and comprising a contact portion, a curved portion connected to the contact portion, and a fixed portion connected to the curved portion and fixed onto the wiring substrate, the wiring substrate comprises a plurality of through holes formed therethrough, and each of the plurality of connection terminals passes through a corresponding one of the through holes, and the respective fixed portions are fixed onto the second surface of the wiring substrate, and the respective contact portions extend from the first surface of the wiring substrate.

13. A socket comprising:

a wiring substrate comprising a first surface and a second surface opposite to the first surface;

a plurality of first connection terminals provided on the first surface of the wiring substrate and formed of a conductive elastic member, each of the first connection terminals comprising:

a first contact portion;

a first curved portion connected to the first contact portion; and a first fixed portion connected to the first curved portion and fixed onto the first surface of the wiring substrate;

a plurality of second connection terminals provided on the second surface of the wiring substrate and formed of a conductive elastic member, each of the second connection terminals comprising:

a second contact portion;

a second curved portion connected to the second contact portion; and a second fixed portion connected to the second curved portion and fixed onto the second surface of the wiring substrate;

a positioning member formed in a frame shape and provided on the wiring substrate to surround the connection terminals, the positioning member comprising a sidewall plate having a plurality of holes formed therethrough, all of the plurality of holes positioned entirely below the wiring substrate and on a same level with the plurality of second connection terminals.

14. The socket according to claim 13, wherein the positioning member comprises a positioning portion that contacts the second surface of the wiring substrate and a side surface of the wiring substrate that extend between the first surface of the wiring substrate and the second surface of the wiring substrate.

15. A socket comprising:

a first substrate comprising: a first surface; a second surface opposite to the first surface; and a plurality of through holes formed therethrough;

a plurality of connection terminals each passing through a corresponding one of the through holes and formed of a conductive elastic member, each of the connection terminals being a continues member comprising:

a first contact portion extending from the first surface of the first substrate;

a second contact portion extending from the second surface of the first substrate;

a first curved portion between the first contact portion and the second contact portion, the first curved portion being continuous with the first contact portion and the second contact portion so as to directly connect to both the first contact portion and the second contact portion;

a fixed portion fixed onto the first substrate; and a second curved portion between the second contact portion and the fixed portion, the second curved portion being continuous with the second contact portion and the fixed portion so as to directly connect to both the second contact portion and the fixed portion, and the second contact portion is disposed between the second curved portion and the first curved portion, and a positioning member formed in a frame shape and provided on the first substrate to surround the connection terminals, the positioning member comprising a sidewall plate having a plurality of holes formed therethrough.

16. The socket according to claim 15, further comprising:

a second substrate comprising a plurality of pads thereon and facing the first substrate, wherein the respective second contact portions of the connection terminals contact a corresponding one of the pads on the second substrate.

17. The socket according to claim 16, wherein the positioning member comprises:

a first positioning portion holding the first substrate in a first substrate position; and a second positioning portion holding the second substrate in a second substrate position that is spaced from the first substrate position and from a bottom surface of the sidewall plate of the positioning member, wherein the first substrate is spaced from the second substrate, and the second substrate position is set such that a bottom surface of the second substrate is disposed above the bottom surface of the sidewall plate of the positioning member so that the second substrate is adapted to be connected to an associated mounting substrate having an upper surface that is level with the bottom surface of the sidewall plate of the positioning member.

* * * * *